US006248512B1

(12) United States Patent
Miura et al.

(10) Patent No.: US 6,248,512 B1
(45) Date of Patent: Jun. 19, 2001

(54) THERMALLY PROCESSABLE PHOTOSENSITIVE MATERIAL, IMAGE FORMING METHOD AND ANTIFOGGANT

(75) Inventors: Norio Miura; Keiko Ishidai, both of Hino (JP)

(73) Assignee: Konica Corporation (JP)

( * ) Notice: Subject to any disclaimer, the term of this patent is extended or adjusted under 35 U.S.C. 154(b) by 0 days.

(21) Appl. No.: 09/288,384

(22) Filed: Apr. 8, 1999

(30) Foreign Application Priority Data

Apr. 13, 1998 (JP) ..... 10-117798
Aug. 14, 1998 (JP) ..... 10-244434

(51) Int. Cl.[7] ..... G03C 1/498

(52) U.S. Cl. ..... 430/619; 430/600; 430/607; 430/613; 430/614; 430/615

(58) Field of Search ..... 430/358, 619, 430/617, 607, 613, 614, 615, 600

(56) References Cited

U.S. PATENT DOCUMENTS 4,003,749 1/1977 Masuda et al. .
5,028,523 * 7/1991 Skoug ..... 430/617

FOREIGN PATENT DOCUMENTS 0829753 3/1998 (EP) .
9522785 8/1995 (WO) .

OTHER PUBLICATIONS

European Search Report EP 99 30 2809 N. D. Cowan, C. J. Ludman & T. C. Weddington: "The Chlorotri–methylammonium & Bromotrimethylammonium Cations" XP–002126746.

* cited by examiner

*Primary Examiner*—Thorl Chea

(74) *Attorney, Agent, or Firm*—Jordan B. Bierman; Bierman, Muserlian and Lucas

(57) ABSTRACT

An image forming method for a thermally processable photosensitive material is disclosed, comprising exposing a thermally processable photosensitive material to light using a laser light source, and subjecting the exposed photosensitive material to thermal processing, wherein the thermally processable photosensitive material comprises a support having thereon an organic silver salt, a binder, a photosensitive silver halide, and a compound containing nitrogen covalently bonded to halogen represented by the following formula or a nitrogen-containing acyclic compound associated with a pair of halogen atoms represented by the following formula

4 Claims, No Drawings

THERMALLY PROCESSABLE PHOTOSENSITIVE MATERIAL, IMAGE FORMING METHOD AND ANTIFOGGANT

FIELD OF THE INVENTION

The present invention relates to a thermally processable photosensitive material, an image forming method and an antifoggant and in particular to a thermally processable photosensitive material, an image forming method and an antifoggant, leading to improved desensitization and raw stock stability as well as reduced fogging without deteriorating image storage stability.

BACKGROUND OF THE INVENTION

Thermally processable photosensitive materials forming photographic images with heat development are disclosed in D. Morgan and B. Shely, U.S. Pat. Nos. 3,152,904 and 3,457,075, and D. H. Klisterboer, "Thermally Processed Silver Systems" in Imaging processes and Materials Neblette's Eighth Edition, Edited by J. M. Sturge, V. Walworth and A. Shepp, page 279, 1989.

Such thermally processable materials comprise a reducible silver source (e.g., organic silver salts), a photocatalysts (e.g., silver halides) in a catalytically active amount, and a reducing agent, each of which is generally dispersed in a (an organic) binder matrix. The thermally processable photosensitive materials are stable at ordinary temperature, and after exposure, when they are heated to high temperatures (e.g., at least 80° C.), silver is formed through an oxidation-reduction reaction of the reducible silver source (working as an oxidizing agent) with a reducing agent. The oxidation-reduction reaction is accelerated with a catalytic action of a latent image produced upon exposure. Silver produced by the reaction of an organic silver salt in an exposed area provides a black image. This is in contrast to the unexposed area, and thereby forms an image. Antifoggants are optionally employed to minimize fog in the formed image.

The most effective method as the conventional fog restraining technique was a method in which mercury compounds were employed as antifoggants. Incorporation of mercury compounds as antifoggants in photosensitive materials is disclosed, for example, in U.S. Pat. No. 3,589,903. However, the mercury compounds are not environmentally desired and development of mercury-free antifoggants has been demanded.

U.S. Pat. No. 4,212,937 discloses a technique for reducing fogging and improving raw stock stability the of films by the use of an organic haloamide compound. Any organic haloamide compound which was applied to a laser-exposed and thermally processable photosensitive material, has not been known as yet. Recently, there have been broadly employed thermally processable photosensitive materials for use in medical laser imaging, which is used for infrared semiconductor laser exposure, and thermally processable photosensitive materials containing a contrast-increasing agent and used for outputting of printing image setter having oscillation wavelengths of 600 to 800 nm. When this compound is applied to a thermally processable photosensitive material suitable for laser exposure, it was proved that not only reduced fogging and improved raw stock stability were achieved but also surprisingly superior effects were unexpectedly obtained such that a fog-increase was effectively inhibited during storage of a processed photosensitive material sample.

JP-A Nos. 4-232939, 9-160164, 9-244178, 9-258367, 9-265150, 9-281640 and 9-319022 (herein, the term JP-A means a unexamined and published Japanese Patent Application) disclose a technique for reducing fogging and improving raw stock stability by use of a nitrogen containing heterocyclic compound having a bromine atom pair. Furthermore, JP-A 10-97026 discloses a technique for improving fogging by use of a quaternary polyhalogenated ammonium, a quaternary polyhalogenated phosphonium or a tertiary polyhalogenated sulfonium. However, these compounds were insufficient in improving effects, scarcely having effects in inhibiting a fog-increase during storage of processed samples.

SUMMARY OF THE INVENTION

An object of the present invention is to provide a thermally processable photosensitive material, in processed sample of which a fog-increase during storage is restrained and an antifogging agent used therefor.

Another object of the invention is to a thermally processable photosensitive material employed in laser imaging for medical use, having high sensitivity, low fog and improved raw stock stability without producing fog during storage of a processed sample thereof; an image forming method by use thereof; and an antifogging agent used therefor.

Further, another object of the invention is to provide a thermally processable photosensitive material used as a film for outputting of an image-setter, having high contrast, high sensitivity, low fog and improved raw stock stability without producing fog during storage of a processed sample thereof; an image forming method by use thereof; and an antifogging agent used therefor.

The above objects of the present invention can be accomplished by the following constitution:

(1) an image forming method for a thermally processable photosensitive material, wherein the method comprises exposing a thermally processable photosensitive material to light by use of a laser light source, the thermally processable photosensitive material comprising a support having thereon an organic silver salt, a binder, a photosensitive silver halide and a compound containing a nitrogen atom which is covalently bonded to a halogen atom;

(2) the image forming method described in (1), wherein the halogen of the compound containing nitrogen covalently bonded to halogen is bromine;

(3) the image forming method described in (1), wherein the compound containing nitrogen covalently bonded to halogen is represented by following formula 1:

Formula 1

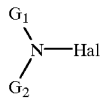

wherein $G_1$ and $G_2$ each represent a hydrogen atom or a substituent capable of being substituted onto a nitrogen atom, provided that $G_1$ and $G_2$ each may have a partial structure having a covalent bond between a nitrogen atom and a halogen atom, or $G_1$ and $G_2$ may combine with each other to form a ring; Hal is a halogen atom;

(4) the image forming method described in (3), wherein the compound represented by formula 1 is represented by the following formula 2:

Formula 2

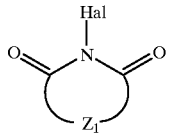

wherein $Z_1$ represents an atomic group necessary to complete a 5- or 6-membered nitrogen-containing heterocyclic ring, along with two carbonyl carbon atoms and a nitrogen atom, which are adjacent with the other, provided that the atomic group represented by $Z_1$ may have a partial structure having a covalent bond between a nitrogen atom and a halogen atom; and Hal is a halogen atom;

(5) a thermally processable photosensitive material, wherein the photosensitive material comprises a support having thereon an organic silver salt, a binder, a photosensitive silver halide and a nitrogen containing compound, which is further associated with a pair of halogen atoms, provided that the nitrogen is not included in a ring;

(6) the thermally processable photosensitive material described in (5), wherein the pair of halogen atoms is a pair of bromine atoms;

(7) the thermally processable photosensitive material described in (5) or (6), wherein the nitrogen containing compound associated with a pair of halogen atoms, in which the nitrogen is not included in a ring, is represented by the following formula 3:

Formula 3

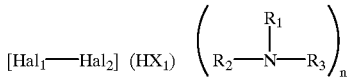

wherein $Hal_1$ and $Hal_2$, which may be the same or different, represent a halogen atom; $X_1$ represents an acid residue; $R_1$ represents a group having a carboxy group as a partial structure; $R_2$ and $R_3$ each represents a hydrogen atom or a substituent except for halogen atoms, which is capable of being substituted onto a nitrogen atom, provided that $R_1$ to $R_3$ are not bonded with each other so as to form a ring in which the nitrogen atom is included; and n is 1 or 2;

(8) an antifogging agent, which is a nitrogen-containing compound associated with a pair of halogen atoms, in which the nitrogen is not included in the ring;

(9) the antifogging agent described in (8), wherein the pair of halogen atoms is a pair of bromine atoms;

(10) an antifogging agent described in (8), which is a nitrogen containing compound associated with a pair of halogen atoms and in which the nitrogen is not included in the ring, is represented by the following formula 3:

Formula 3

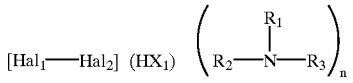

wherein $Hal_1$ and $Hal_2$, which may be the same or different, represent a halogen atom; $X_1$ represents an acid residue; $R_1$ represents a group having a carboxy group as a partial structure; $R_2$ and $R_3$ each represents a hydrogen atom or a substituent except for halogen atoms, which is capable of being substituted onto a nitrogen atom, provided that $R_1$ to $R_3$ are not bonded with each other so as to form a ring in which the nitrogen atom is included; and n is 1 or 2.

(11) a thermally processable photosensitive material comprising a support having thereon an organic silver salt, a binder, a photosensitive silver halide and a nitrogen containing acyclic compound associated with a pair of halogen atoms, the nitrogen containing compound being in the form of a salt of hydrofluoric acid, hydrochloric acid, hydroiodic acid, carboxylic acid, sulfonic acid or phosphoric acid.

(12) the thermally processable photosensitive material described in (11), wherein the pair of halogen atoms is a pair of bromine atoms.

(13) the thermally processable photosensitive material described in (11) wherein the nitrogen containing cyclic compound is represented by the following formula 4:

Formula 4

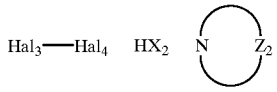

wherein $Hal_3$ and $Hal_4$ each represent a pair of halogen atoms, provided that $Hal_3$ and $Hal_4$ may be the same or different; $X_2$ represents F, Cl, I, a carboxylic acid residue, sulfonic acid residue or a phosphoric acid residue; and $Z_2$ represents an atomic group necessary to complete a 5-, 6- or 7-membered nitrogen containing ring, which may be fused with or bonded through a linkage group to another ring;

(14) an antifogging agent, which is a nitrogen containing cyclic compound associated with a pair of halogen atoms and which is in the form of a salt of hydrofluoric acid, hydrochloric acid, hydroiodic acid, carboxylic acid, sulfonic acid or phosphoric acid;

(15) the antifogging agent described in (14), wherein the pair of halogen atoms is a pair of bromine atoms.

(16) the antifogging agent described in (14) or (15), wherein the antifogging agent is represented by the following formula 4:

Formula 4

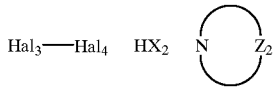

wherein $Hal_3$ and $Hal_4$ each represent a pair of halogen atoms, provided that $Hal_3$ and $Hal_4$ may be the same or different; $X_2$ represents F, Cl, I, a carboxylic acid residue, sulfonic acid residue or a phosphoric acid residue; and $Z_2$ represents an atomic group necessary to complete a 5-, 6- or 7-membered nitrogen containing ring, which may be fused with or bonded through a linkage group to another ring;

(17) a thermally processable photosensitive material comprising a support having thereon an organic silver salt, a binder, a photosensitive silver halide and a nitrogen-containing compound associated with a pair of halogen atoms, wherein the nitrogen containing compound is represented by the following formula 5:

Formula 5

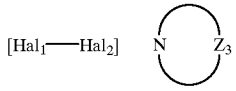

wherein $Hal_1$–$Hal_2$ represents a pair of halogen atoms selected from the group consisting of I—Br, I—Cl, I—F, Br—Cl and Cl—F and $Z_3$ represents an atomic group necessary to complete a 5-, 6- or 7-membered nitrogen containing heterocyclic ring;

(18) an antifogging agent, which is a nitrogen-containing compound associated with a pair of halogen atoms, wherein the nitrogen containing compound is represented by the following formula 5:

Formula 5

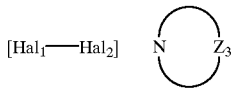

wherein $Hal_1$–$Hal_2$ represents a pair of halogen atoms selected from the group consisting of I—Br, I—Cl, I—F, Br—Cl and Cl—F, and $Z_3$ represents an atomic group necessary to complete a 5-, 6- or 7-membered nitrogen containing heterocyclic ring;

(19) an image forming method of a thermally processable photosensitive material, wherein the photosensitive material comprises a support having thereon an organic silver salt, a binder, a photosensitive silver halide and a hydrobromic acid salt of a nitrogen-containing heterocyclic compound associated with a pair of bromine atoms and having a molecular weight of not less than 80; the method comprising exposure of the photosensitive material to light using a laser light source;

(20) the image forming method described in (19), wherein the nitrogen containing heterocyclic ring is a quinoline ring, isoquinoline ring or a substituted pyridine ring;

(21) a thermally processable photosensitive material, characterized in that the photosensitive material comprises a support having thereon an organic silver salt, a binder, a photosensitive silver halide and a hypohalite;

(22) the thermally processable photosensitive material described in (21), wherein the hypohalite is a hypobromite;

(23) a thermally processable photosensitive material, characterized in that the photosensitive material comprises a support having thereon an organic silver salt, a binder, a photosensitive silver halide and a compound represented by the following formula 6:

Formula 6

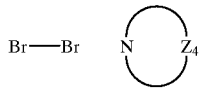

wherein $Z_4$ represents an atomic group necessary to complete a 5-, 6- or 7-membered heterocyclic ring, which may be fused with or bonded through a linkage group to another ring;

(24) an antifogging agent, wherein the antifogging agent is a compound represented by the following formula 5:

Formula 6

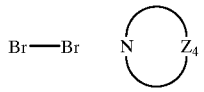

wherein $Z_4$ represents an atomic group necessary to complete a 5-, 6- or 7-membered heterocyclic ring, which may be fused with or bonded through a linkage group to another ring;

(25) an image forming method of a thermally processable photosensitive material, wherein the photosensitive material comprises a support having thereon a photosensitive layer containing an organic silver salt, a binder and a photosensitive silver halide; the photosensitive layer further containing a compound having a covalent bond between a nitrogen atom and a halogen atom, as described in any of (1) to (4); and the method comprising exposure of the photosensitive material to light using a laser light source;

(26) a thermally processable photosensitive material, wherein the photosensitive material comprises a support having thereon a photosensitive layer containing an organic silver salt, a binder and a photosensitive silver halide; the photosensitive layer further containing ac nitrogen containing cyclic compound associated with a pair of halogen atoms described in any of (5) to (7);

(27) a thermally processable photosensitive material, wherein the photosensitive material comprises a support having thereon a photosensitive layer containing an organic silver salt, a binder and a photosensitive silver halide; the photosensitive layer further containing a nitrogen containing cyclic compound associated with a pair of halogen atoms described in any of (11) to (13);

(28) a thermally processable photosensitive material, characterized in that the photosensitive material comprises a support having thereon a photosensitive layer containing an organic silver salt, a binder and a photosensitive silver halide; the photosensitive layer further containing a nitrogen-containing compound associated with a pair of halogen atoms, as described in (17);

(29) an image forming method of a thermally processable photosensitive material, wherein the photosensitive material comprises a support having thereon a photosensitive layer containing an organic silver salt, a binder, a photosensitive silver halide and a hydrobromic acid salt of a nitrogen-containing compound associated with a pair of bromine atoms and having a molecular weight of not less than 80, as described in (19), the method comprising exposure of the photosensitive material to light using a laser light source;

(30) a thermally processable photosensitive material, wherein the photosensitive material comprises a support having thereon a photosensitive layer containing an organic silver salt, a binder and a photosensitive silver halide, the photosensitive layer further containing a hypohalite described in (21);

(31) a thermally processable photosensitive material, wherein the photosensitive material comprises a support having thereon a photosensitive layer containing an organic silver salt, a binder and a photosensitive silver halide, the photosensitive layer further containing a compound described in (23); and

(32) a thermally processable photosensitive material herein, when the photosensitive material further comprises a hydrazine compound.

DETAILED DESCRIPTION OF THE INVENTION

In one embodiment of the present invention, the thermally processable photosensitive material comprising a support having thereon a photothermographic emulsion comprising an organic silver salt, photosensitive silver halide, a binder and a compound containing a nitrogen atom, which is covalently bonded to a halogen atom, is exposed to laser light by the use of a laser light source. The compound containing nitrogen covalently bonded to halogen (i.e., a compound having a covalent bond between a nitrogen atom and halogen atom) is preferably represented by formula 1.

In the formula, $G_1$ and $G_2$ each represent a hydrogen atom or substituents capable of being substituted onto a nitrogen atom. Examples of the substituents include a halogen atom (e.g., chlorine atom, atom, iodine atom, fluorine atom, and preferably a bromine atom); an alkyl group (preferably having 1 to 20 carbon atoms, more preferably 1 to 12 carbon atoms, and still more preferably 1 to 8 carbon atoms, such as methyl, trifluoromethyl, ethyl, isopropyl, tert-butyl, n-octyl, n-decyl, n-hexyl, cyclopropyl, cyclopentyl, cyclohexyl, etc.); an alkenyl group (preferably having 2 to 20 carbon atoms, more preferably 2 to 12 carbon atoms, and still more preferably 2 to 8 carbon atoms, such as vinyl, allyl, 2-butenyl, 3-pentenyl, etc.); an alkynyl group (preferably having 2 to 20 carbon atoms, more preferably 2 to 12 carbon atoms, and still more preferably 2 to 8 carbon atoms, such as propargyl, 3-pentynyl, etc.); an aryl group (preferably having 6 to 30 carbon atoms, more preferably 6 to 20 carbon atoms, and still more preferably 6 to 12 carbon atoms, such as phenyl, p-methylphenyl, naphthyl, etc.); an amino group (preferably having 0 to 20 carbon atoms, more preferably 0 to 10 carbon atoms, and still more preferably 0 to 6 carbon atoms, such as amino, methylamino, dimethylamino, diethylamino, dibenzylamino, etc.); an acyl group (preferably having 1 to 20 carbon atoms, more preferably 1 to 16 carbon atoms, and still more preferably 1 to 12 carbon atoms, such as acetyl, benzoyl, formyl, pivaloyl, etc.); an alkoxycarbonyl group (preferably having 2 to 20 carbon atoms, more preferably 2 to 16 carbon atoms, and still more preferably 2 to 12 carbon atoms, such as methoxycarbonyl, ethoxycarbonyl, etc.); aryloxycarbonyl group preferably having 7 to 20 carbon atoms, more preferably 7 to 16 carbon atoms, and still more preferably 7 to 12 carbon atoms, such as phenyoxycarbonyl); an acylamino group (preferably having 2 to 20 carbon atoms, more preferably 2 to 16 carbon atoms, and still more preferably 2 to 12 carbon atoms, such as acetylamino, benzoylamino, etc.); an alkoxycarbonylamino group (preferably having 2 to 20 carbon atoms, more preferably 2 to 16 carbon atoms, and still more preferably 2 to 12 carbon atoms, such as methoxycarbonylamino), an aryloxycarbonylamino group (preferably having 7 to 20 carbon atoms, more preferably 7 to 16 carbon atoms, and still more preferably 7 to 12 carbon atoms, such as phenyloxycarbonylamino); a sulfonylamino group (preferably having 1 to 20 carbon atoms, more preferably 1 to 16 carbon atoms, and still more preferably 1 to 12 carbon atoms, such as methanesulfonylamino, benzenesulfonylamino, etc.); a sulfamoyl group (preferably having 0 to 20 carbon atoms, more preferably 0 to 16 carbon atoms, and still more preferably 0 to 12 carbon atoms, such as sulfamoyl, methylsulfamoyl, dimethylsulfamoyl, etc.); a carbamoyl group (preferably having 1 to 20 carbon atoms, more preferably 1 to 16 carbon atoms, and still more preferably 1 to 12 carbon atoms, such as carbamoyl, methylcarbamoyl, diethylcarbamoyl, phenylcarbamoyl, etc.); an alkylsulfonyl group (preferably having 1 to 20 carbon atoms, more preferably 1 to 16 carbon atoms, and still more preferably 1 to 12 carbon atoms, such as methylsulfonyl, ethylsulfonyl, etc.), an arylsulfonyl group (preferably having 6 to 20 carbon atoms, more preferably 6 to 16 carbon atoms, and still more preferably 6 to 12 carbon atoms, such as phenylsulfonyl); a sulfinyl group (preferably having 1 to 20 carbon atoms, more preferably 1 to 16 carbon atoms, and still more preferably 1 to 12 carbon atoms, such as methanesufinyl, benzenesufinyl, etc.); a ureido group (preferably having 1 to 20 carbon atoms, more preferably 1 to 16 carbon atoms, and still more preferably 1 to 12 carbon atoms, such as ureido, methylureido, phenylureido); a silyl group e.g., trimethylsilyl); nitro; hydroxy; a phosphoric acid ester group; and a heterocyclic ring group (e.g., triazolyl, imidazolyl, pyridyl, piperazyl, piperidyl, morphorino, etc.). These substituents may further be substituted. The $G_1$ and $G_2$ each may have a partial structure having a covalent bond between a nitrogen atom and a halogen atom, thus, the G1 and G2 each may further contain nitrogen covalently bonded to halogen. Furthermore, the $G_1$ and $G_2$ may combine together with each other to form a ring. The ring formed by $G_1$ and $G_2$ is preferably a 5- or 6-membered nitrogen containing heterocyclic ring.

The halogen atom represented by Hal is a chlorine atom, bromine atom, iodine atom or fluorine atom, and preferably a bromine atom.

The compound represented by formula 2 will be further described. $Z_1$ represents an atom group necessary to complete a 5- or 6-membered nitrogen containing heterocyclic group, along with two adjacent carbon atoms and a nitrogen atom. The nitrogen containing heterocyclic ring is a preferably a 5-membered heterocyclic ring. The atomic group represented by $Z_1$ may further have a partial structure having a covalent bond between a nitrogen atom and a halogen atom. The halogen atom represented by Hal include a chlorine atom, bromine atom, iodine atom, fluorine atom, and preferably a bromine atom.

In another embodiment of the present invention, the thermally processable photosensitive material comprises a support having thereon an organic silver salt, a photosensitive silver halide, a binder and a nitrogen-containing acyclic compound associated with a pair of halogen atoms, in which the nitrogen is not to be included in a cyclic ring. The preferred nitrogen-containing acyclic compound is represented by formula 3.

The compound represented by formula 3 will be further described. Halogen atoms represented by $Hal_1$ and $Hal_2$, which may be the same or different, independently represent a chlorine atom, a bromine atom, iodinr atom or fluorine atom, and preferably, both are bromine atoms. Suitable examples of the acid residue represented by $X_1$ include a hydrohalogenic acid residue (e.g., Cl, Br, I and F), a carboxylic acid residue (such as RCOO—), sulfonic acid anion residue (such as $RSO_3$—) and phosphoric acid anion residue (such as $H_2PO_4$), preferably a hydrohalogenic acid residue, and more preferably hydrobromic acid residue (i.e., Br).

$R_1$ represents a group having a carbonyl group as a partial structure, and preferred examples thereof including an an acyl group (preferably having 1 to 20 carbon atoms, more preferably 1 to 16 carbon atoms, and still more preferably 1 to 12 carbon atoms, such as acetyl, benzoyl, formyl and pivaloyl), an alkoxycarbonyl group (preferably having 2 to 20 carbon atoms, more preferably 2 to 16 carbon atoms, and still more preferably 2 to 12 carbon atoms, such as methoxycarbonyl and ethoxycarbonyl), an aryloxycarbonyl group (preferably having 7 to 20 carbon atoms, more preferably 7 to 16 carbon atoms, and still more preferably 7 to 12 carbon atoms, such as phenyloxycarbonyl), an acylamino group (preferably having 2 to 20 carbon atoms, more preferably 2 to 16 carbon atoms, and still more preferably 2 to 12 carbon atoms, such as acetylamino and benzoylamino), an alkoxycarbonylamino group (preferably having 2 to 20 carbon atoms, more preferably 2 to 16 carbon atoms, and still more preferably 2 to 12 carbon atoms, such as methoxycarbonylamino), an aryloxycarbonylamino group (preferably having 7 to 20 carbon atoms, more preferably 7 to 16 carbon atoms, and still more preferably 7 to 12 carbon atoms, such as phenyloxycarbonylamino), an carbamoyl group (preferably having 1 to 20 carbon atoms, more preferably 1 to 16 carbon atoms, and still more preferably 1 to 12 carbon atoms, such as carbamoyl, methylcarbamoyl, diethylcarbamoyl and phenylcarbamoyl), and an ureido group (preferably having 1 to 20 carbon atoms, more preferably 1 to 16 carbon atoms, and still more preferably 1 to 12 carbon atoms, such as ureido, methylureido and phenylureido). Of these, an acyl group is preferable and acetyl is more preferable. $R_2$ and $R_3$ each represent a hydrogen atom or a substituent capable of being substituted onto a nitrogen atom. The substituent is the same as defined in the substituent represented by G1 and G2 of formula 1. Further, the compound represented by formula 3 is a nitrogen-containing compound associated with a pair of halogen atoms. Thus, in formula 3, $R_1$, $R_2$ and $R_3$ do not combine with each other to form a ring so that the nitrogen atom is not to be included in the ring. Furthermore, n is 1 or 2, and preferably 2.

The compound represented by formula 4 will be further detailed. Halogen atoms represented by $Hal_3$ and $Hal_4$, which may be the same or different, include a chlorine atom bromine atom, iodine atom and fluorine atom, and preferably both are bromine atoms. Z2 represents an atom group necessary to form a 5-, 6- or 7-membered nitrogen containing heterocyclic ring. The formed nitrogen containing heterocyclic ring is preferably an aromatic nitrogen containing heterocyclic ring, including pyrrole, imidazole, pyrazole, pyridine, pyrazine, pyridazine, pyrimidine, triazole, triazine, tetrazine, pentazine, indole, indazole, purine, thiadiazole, oxadiazole, quinoline, isoquinoline, phthalazine, naphthylizine, quinoxaline, quinazoline, cinnoline, pteridine, acrydine, phenthroline, phenazine, tetrazole, thiazole, oxazole, benzimidazole, benzoxazole, and benzthiazole. Of these, pyridine, pyrazine, pyrimidine, pyridazine, triazine, quinoline, isoquinoline, naphthylidine, quinooxaline, quinazoline, and pteridine are preferred; and pyridine, quinoline and isoquinoline are more preferred.

The compound represented by formula 5 or 6 will be further detailed. In formula 5, $Hal_1$–$Hal_2$ is a pair of halogen atoms selected from the group consisting of I—Br, I—Cl, I—F, Br—Cl and Cl—F. Of these is preferred I—Br or I—F. In formula 5 or 6, $Z_3$ and $Z_4$ each represent an atomic group necessary to form a 5-, 6- or 7-membered nitrogen containing heterocyclic ring. The formed nitrogen containing heterocyclic ring is preferably an aromatic nitrogen containing heterocyclic ring, including pyrrole, imidazole, pyrazole, pyridine, pyrazine, pyridazine, pyrimidine, triazole, triazine, tetrazine, pentazine, indole, indazole, purine, thiadiazole, oxadiazole, quinoline, isoquinoline, phthalazine, naphthylizine, quinoxaline, quinazoline, cinnoline, pteridine, acrydine, phenthroline, phenazine, tetrazole, thiazole, oxazole, benzimidazole, benzoxazole, and benzthiazole. Of these, pyridine, pyrazine, pyrimidine, pyridazine, triazine, quinoline, isoquinoline, naphthylidine, quinooxaline, quinazoline, and pteridine are preferred; and pyridine, quinoline and isoquinoline are more preferred.

Exemplary examples of the compound having a covalent bond between a nitrogen atom and a halogen atom, as described in items (1) to (4), the nitrogen containing compound associated with a pair of halogen atoms, in which the nitrogen atom is not included a ring as described in items (5) to (10), the cyclic nitrogen containing compound associated with a pair of halogen atoms and in the form of a hydrofluoric acid salt, hydrochloric acid salt, hydroiodic acid salt, carboxylic acid salt, sulfonic acid salt or phosphoric acid salt as described in items (11) to (16), the nitrogen containing compound associated with a halogen atom pair selected from I—Br, I—Cl, I—F, Br—Cl and Cl—F as described in items (17) and (18), the hydrobromic acid salt of the nitrogen containing compound associated with a pair of bromine atoms and having a molecular weight of not less than 80 as described in items (19) and (20), the hypohalite compound described in items (21) and (22), and the compound represented by formula 5, as described in items (23) and (24) are shown below, but are not limited to these examples.

Compound having a covalent bond between a nitrogen atom and a halogen atom, as described in items (1) to (4):

A1

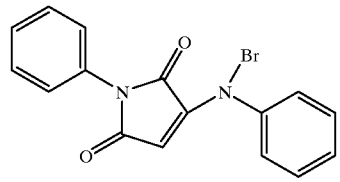

A2

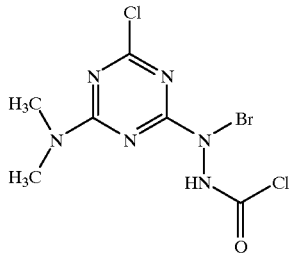

A3

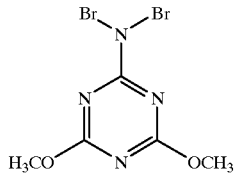

A4

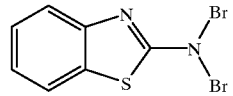

A5

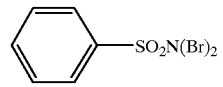

A6

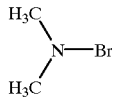

A7

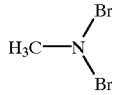

A8

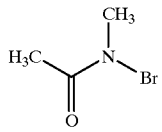

-continued
A9
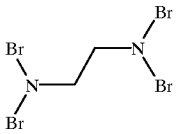
A10
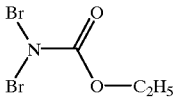
A11
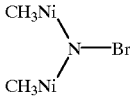
A12
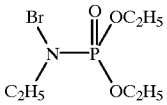
A13
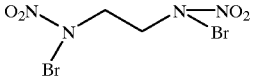
A14
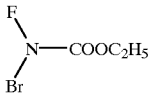
A15
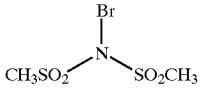
A16
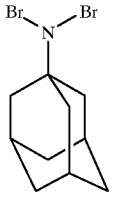
A17
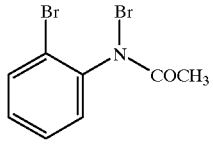
A18
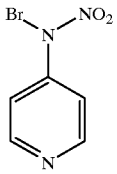
A19
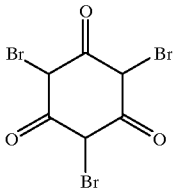
-continued
A20
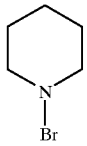
A21
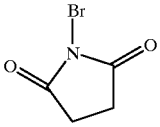
A22
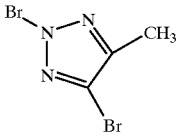
A23
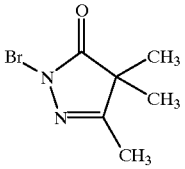
A24
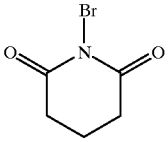
A25
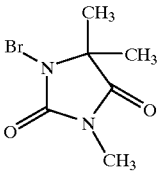
A26
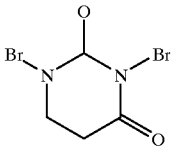
A27
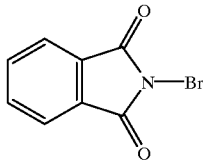
A28
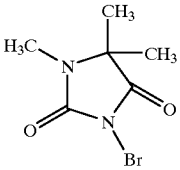

-continued
A29
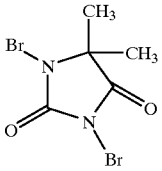
A30
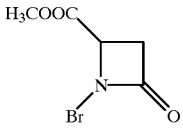
A31
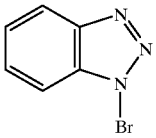
A32
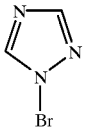
A33
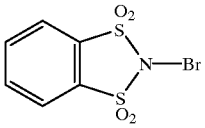
A34
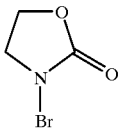
A35
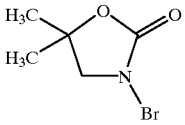
A36
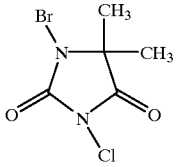
A37
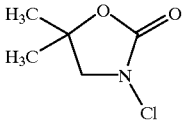
A38
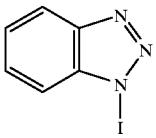
-continued
A39
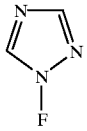
A40
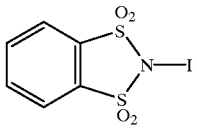
A41
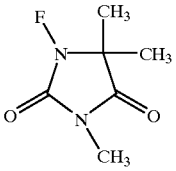
A42
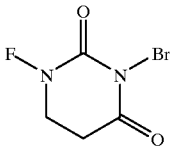
A43
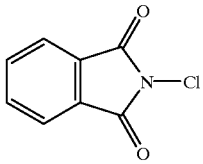
A44
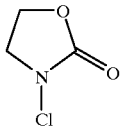
A45
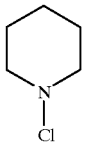
A46
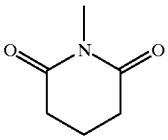
A47
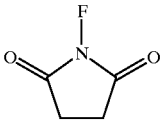
A48
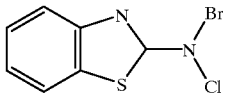

-continued

A49

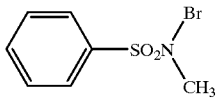

A50

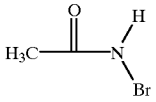

Nitrogen containing compound associated with a pair of halogen atoms, in which the nitrogen atom is not included a ring as described in items (5) to (10):

B1

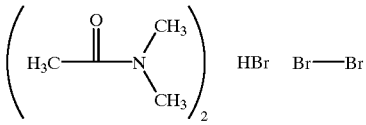

B2

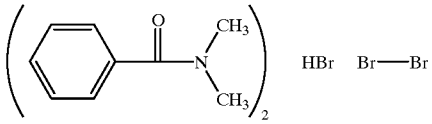

B3

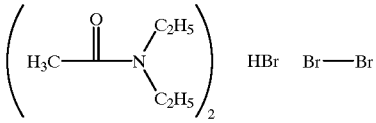

B4

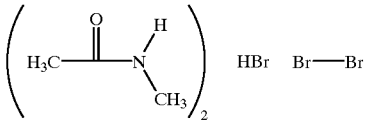

B5

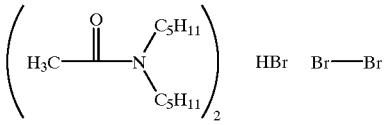

B6

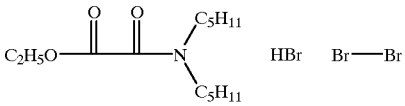

B7

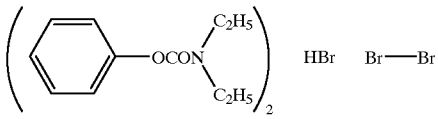

B8

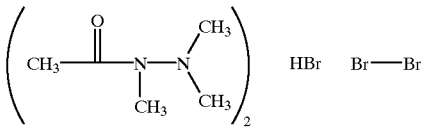

-continued

B9

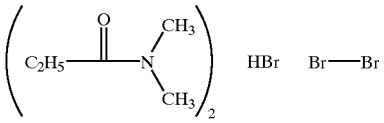

B10

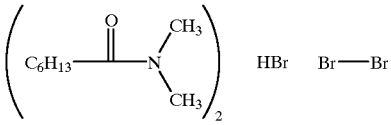

B11

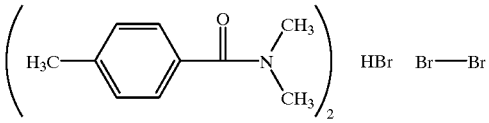

B12

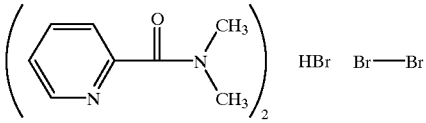

Acyclic nitrogen containing compound associated with a pair of halogen atoms and in the form of a hydrofluoric acid salt, hydrochloric acid salt, hydroiodic acid salt, carboxylic acid salt, sulfonic acid salt or phosphoric acid salt as described in items (11) to (16):

C1

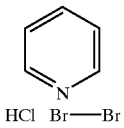

C2

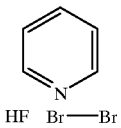

C3

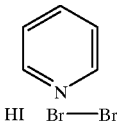

C4

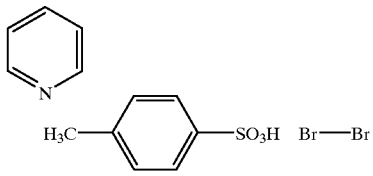

C5

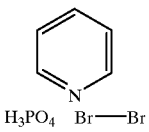

-continued
C6
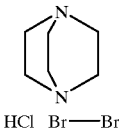
HCl Br—Br
C7
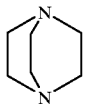
HF Br—Br
C8
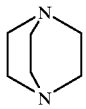
HI Br—Br
C9
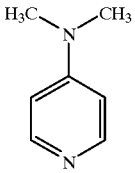
HCl Br—Br
C10
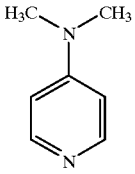
HF Br—Br
C11
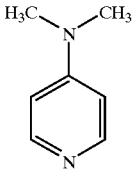
HI Br—Br
C12
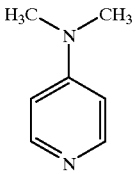
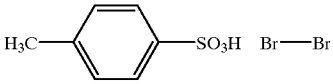
C13
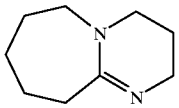
HCl Br—Br
-continued
C14
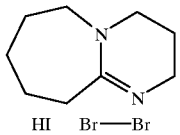
HI Br—Br
C15
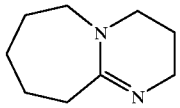
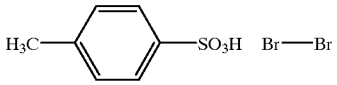
C16
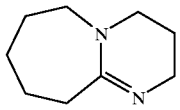
$CH_3COOH$ Br—Br
C17
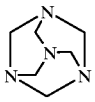
HCl Br—Br
C18
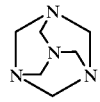
HI Cl—Cl
C19
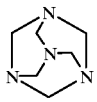
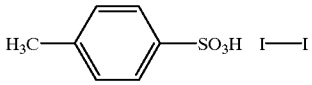
C20
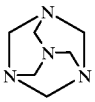
$CH_3COOH$ Br—Br
C21
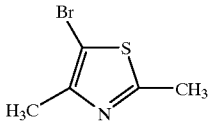
HCl Br—Br
C22
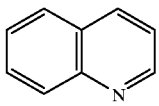
HCl Br—Br -continued

C23

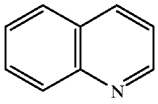

HF Br—Br

C24

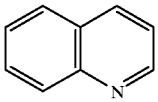

HI Br—Br

C25

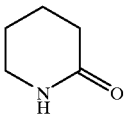

HCl Br—Br

C26

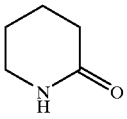

HF Br—Br

C27

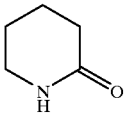

HI Br—Br

C28

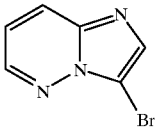

HCl Br—Br

Nitrogen containing compound associated with a pair of halogen atoms selected from I—Br, I—Cl, I—F, Br—Cl and Cl—F as described in items (17) and (18):

D2

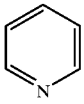

I—Br

D5

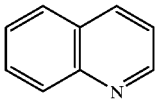

I—Br

D7

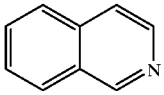

I—Br

-continued

D9

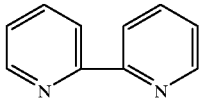

2I—Br

D12

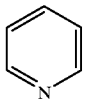

I—Cl

D15

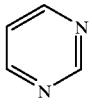

2I—Cl

D16

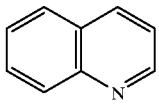

I—Br

D18

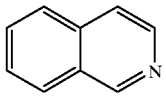

I—Cl

D20

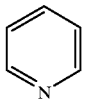

I—F

D22

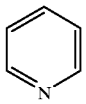

Br—Cl

D24

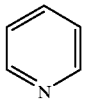

Cl—F

Hydrobromic acid salt of the nitrogen containing compound associated with a pair of bromine atoms and having a molecular weight of not less than 80 as described herein:

E1

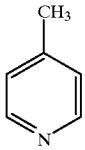

HBr Br—Br

-continued
E2
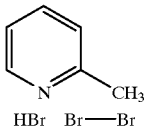
E3
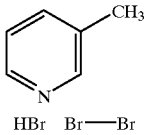
E4
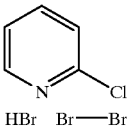
E5
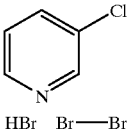
E6
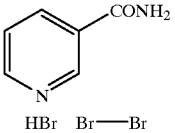
E7
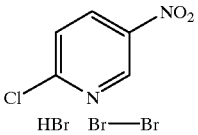
E8
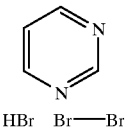
E9
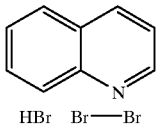
E10
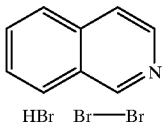
E11
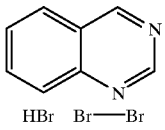
-continued
E12
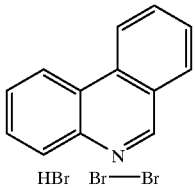
E13
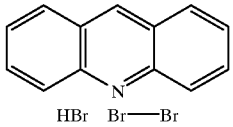
E14
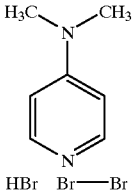
E15
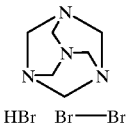
E16
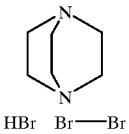
E17
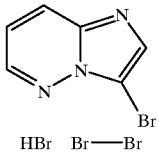
E18
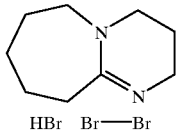
E19
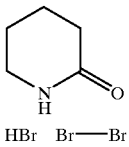
E20
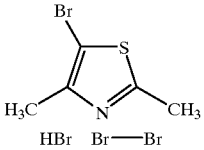

Hypohalite compound described in claims 21 and 22:
| | |
|---|---|
| F1 | NaOBr |
| F2 | NaOCl |
| F3 | NaOI |
| F4 | KOBr |
| F5 | KOCl |
| F6 | KoI |
Compound represented by formula 5, as described in claims 23 and 24:
G1
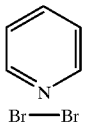
G2
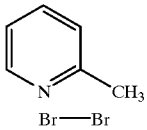
G3
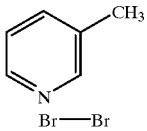
G4
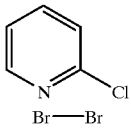
G5
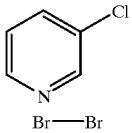
G6
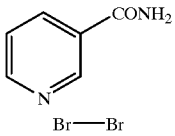
G7
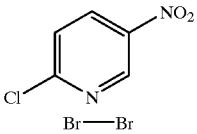
G8
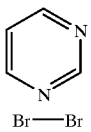
-continued
G9
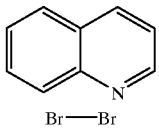
G10
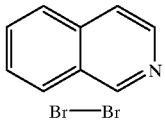
G11
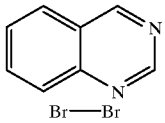
G12
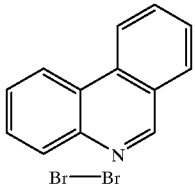
G13
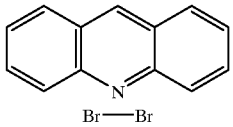
G14
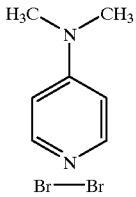
G15
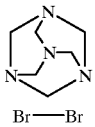
G16
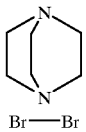
G17
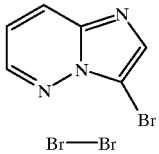
G18
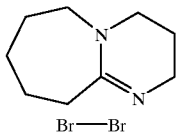

-continued

G19

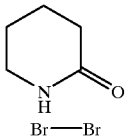

G20

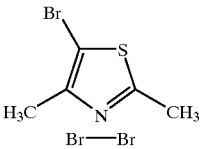

G21

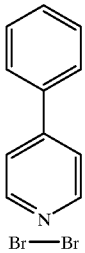

G22

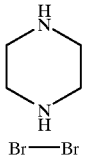

G23

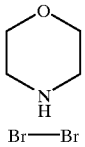

G24

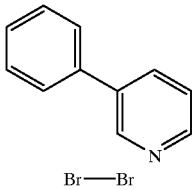

The compounds described above are known and commercially available from a chemicals maker, such as Tokyo Kasei Co., and can be readily synthesized, with reference to the following literatures. Representative literatures are shown below: Nihon Kagaku Zashi 78 1400 (1957); Arm. Khim. Zh 30 845 (1977), DE No. 2018719; Dokl. Chem. 146 851 (1962); J. Prakt. Chem. [2] 129 273 (1931); j. Gen. Chem. USSR 56 [6] 1147 (1986); Zh. Obshch. Khim. 26 3139 (1956); Angew. Chem.71 126 (1959); Seances Acad, Sci. 136 1471 (1903); J. Amer. Chem. Soc. 79 4622 (1957); Bull. Soc. Chim. Fr.[3] 7 73 (1892); J. Chem. Soc. 2783 (1931); J. Prakt. Chem. [2] 145 257 (1936); J. Chem. Soc. Dalton Trans. 821 (1980); J. Chem. Soc. Dalton Trans. 15 2261 (1993); Bull. Chem. Soc. Jpn. 31 347 (1958); Chem. Ber. 16 559 (1883); Rec. Tav. Chim. Pays-Bas. 6 380 (1887); Chem. Ber. 40 4572 (1907); Zh. Org. Khim. 6 2150 (1970); Synthesis page 573 (1979); SU No. 968261; J. Amer. Chem. Soc. 91 1679 (1969); J. Org. Chem. 37 2172 (1972); J. Chem. Soc. 77 799 (1900); Pol. J. Chem. 69 [4] 605 (1995); Angew. Chem. 36 [21] 2342 (1997); Bull. Chem. Soc. Jpn. 60 4187 (1997); Chem. Ber. 26 425 (1893); Liebigs Ann. Chem. 607 109 (1957); Org. Synth. Coll. Vol. IV page 489 (1963); An. Asoc. Quim Angent. 37 192 (1949); J. Org. Chem. 28 1100 (1963); Tetrahedron Lett. 2 117 (1969); Chem. Heterocycl Compd. Vol 5 page 844 (1969); J. Chem. Soc. Perkin Trans. 1 909 (1978); J. Org. Chem. 34 3434 (1969); Synthesis Vol. 6 page 511 (1979); Tetrahedron 38 10977 (1976); J. Chem. Res. Miniprint Vol. 7 1734 (1995); J. Chem. Soc. 2783 (1931); Justus Liebigs Ann. Chem. 346 217 (1906); Chem. Ber. 34 2087 (1901); Chem. Ber. 36 987 (1981); Collext. Czeuch. Chem. Commun. 53 [12] 3166 (1988); Bull. Chem. Soc. Jpn. 60 [3] 1159 (1987); Synthesis Vol. 12 page 987 (1981); Bull. Chem. Soc. Jpn. 64 [3] 796 (1991); Justus Liebigs Ann. Chem. 679 133 (1961); J. Org. Chem. USSR 24 [3] 449 (1988); J. Chem. Soc. Chem. Commun. Vol. 16 page 1127 (1985); J. Org. Chem. USSR 28 [9] 1543 (1992); Bull. Chem. Soc. Jpn. 60 [7] 2667 (1987) Synth. Commun. 25 [21] 3497 (1995); J. Org. Chem. USSR 28 [9] 1543 (1992); Bull. Chem. Soc. Jpn. 44 1141 (1971); and J. Amer. Chem. Soc. 19 562 (1897).

The addition amount of the compound represented by formulas 1 to 5 is not specifically limited, but preferably $10^{-4}$ to 1 mol/Ag mol, and more preferably $10^{-3}$ to 0.3 mol/Ag mol.

The compound represented by formulas 1 to 5 may be incorporated into a photosensitive layer or a nonphotosensitive layer, and preferably a photosensitive layer. Representative embodiments include a thermally processable photosensitive material comprising a support having thereon a photosensitive layer and a layer adjacent thereto, wherein (1) the photosensitive layer contains a photosensitive silver halide, an organic salt, a binder and a compound represented by formulas 1 to 5; (2) the photosensitive layer containing a photosensitive silver halide, an organic salt and a binder, and the adjacent layer containing a compound represented by formulas 1 to 5; (3) the photosensitive layer containing a photosensitive silver halide, a binder and a compound represented by formulas 1 to 5, and the adjacent layer containing an organic silver salt; (4) the photosensitive layer containing a photosensitive silver halide and a binder, and a compound represented by formulas 1 to 5, and the adjacent layer containing an organic silver salt and a compound represented by formulas 1 to 5. Of these, embodiment (1) is preferred.

The compound represented by formulas 1 to 5 is preferably incorporated through solution in an organic solvent.

Silver halide grains of photosensitive silver halide in the present invention work as a light sensor. In order to minimize cloudiness after image formation and to obtain excellent image quality, the less the average grain size, the more preferred, and the average grain size is preferably less than 0.2 $\mu$m, more preferably between 0.03 and 0.15 $\mu$m, and still more preferably between 0.03 and 0.11 $\mu$m. The average grain size as described herein is defined as an average edge length of silver halide grains, in cases where they are so-called regular crystals in the form of cube or octahedron. Furthermore, in cases where grains are not regular crystals, for example, spherical, cylindrical, and tabular grains, the grain size refers to the diameter of a sphere having the same volume as the silver grain.

Furthermore, silver halide grains are preferably monodisperse grains. The monodisperse grains as described herein refer to grains having a monodispersibility obtained by the formula described below of less than 40 percent; more preferably less than 30 percent, and most preferably from 0.1 to 20 percent.

Monodispersibility=(standard deviation of grain diameter)/(average grain diameter)×100

The silver halide grain shape is not specifically limited, but a high ratio accounted for by a Miller index [100] plane is preferred. This ratio is preferably at least 50 percent; is more preferably at least 70 percent, and is most preferably at least 80 percent. The ratio accounted for by the Miller index [100] plane can be obtained based on T. Tani, J. Imaging Sci., 29, 165 (1985) in which adsorption dependency of a [111] plane and a [100] plane is utilized.

The average grain diameter of the above-mentioned monodisperse grains is preferably less than 0.1 μm; is more preferably between 0.01 and 0.1 μm, and is most preferably between 0.02 and 0.08 μm.

Furthermore, another preferred silver halide shape is a tabular grain. The tabular grain as described herein is a grain having an aspect ratio represented by r/h of at least 3, wherein r represents a grain diameter in μm defined as the square root of the projection area, and h represents thickness in μm in the vertical direction. Of these, the aspect ratio is preferably between 3 and 50.

The grain diameter is preferably not more than 0.1 μm, and is more preferably between 0.01 and 0.08 μm. These are described in U.S. Pat. Nos. 5,264,337, 5,314,789, 5,320,958, and others. In the present invention, when these tabular grains are used, image sharpness is further improved.

The composition of silver halide may be any of silver chloride, silver chlorobromide, silver chloroiodobromide, silver bromide, silver iodobromide, or silver iodide. The photographic emulsion employed in the present invention can be prepared employing methods described in P. Glafkides, "Chimie et Physique Photographique" (published by Paul Montel Co., 1967), G. F. Duffin, "Photographic Emulsion Chemistry" (published by The Focal Press, 1966), V. L. Zelikman et al., "Making and Coating Photographic Emulsion" (published by The Focal Press, 1964), etc.

Namely, any of several acid emulsions, neutral emulsions, ammonia emulsions, and the like may be employed. Furthermore, when grains are prepared by allowing soluble silver salts to react with soluble halide salts, a single-jet method, a double-jet method, or combinations thereof may be employed.

The resulting silver halide may be incorporated into an image forming layer utilizing any practical method, and in this case, silver halide is placed in close proximity to a reducible silver source.

Silver halide may be prepared by converting a part or all of an organic silver salt into silver halide through the reaction of the organic silver salt with halogen ions. Silver halide may be preformed and the formed silver halide may be added to a solution to prepare the organic silver salt, or combinations thereof may be used, and the latter is preferred.

Generally, the content of silver halide in organic silver salt is preferably between 0.75 and 30 weight percent, based on the organic silver salt.

Silver halide preferably occludes ions of metals or complexes thereof, in transition metal belonging to Groups VIB, VIIB, VIII and IB of the Periodic Table. Preferred as the metals are Cr and W (in Group VIB); Re (in Group VIIB); Fe, Co, Ni, Ru, Rh, Pd, Os, Ir, and Pt (in group VIII); and Cu and Au (in Group IB). Of these, when employed for printing plate-making photosensitive materials, it is preferred to use Rh, Re, Ru, Ir, or Os.

These metals may be introduced into silver halide in the form of a complex. In the present invention, regarding the transition metal complexes, six-coordinate complexes represented by the general formula described below are preferred:

Formula $(ML_6)^m$:

wherein M represents a transition metal selected from elements in Groups VIB, VIIB, VIII, and IB of the Periodic Table; L represents a coordinating ligand; and m represents 0, −1, −2, or −3.

Exemplary examples of the ligand represented by L include halides (fluoride, chloride, bromide, and iodide), cyanide, cyanato, thiocyanato, selenocyanato, tellurocyanato, azido and aquo, nitrosyl, thionitrosyl, etc., of which aquo, nitrosyl and thionitrosyl are preferred. When the aquo ligand is present, one or two ligands are preferably coordinated. L may be the same or different.

The particularly preferred example of M is rhodium (Rh), ruthenium (Ru), rhenium (Re) or osmium (Os).

Exemplary examples of transition metal ligand complexes are shown below.

1: $[RhCl_6]^{3-}$
2: $[RuCl_6]^{3-}$
3: $[ReCl_6]^{3-}$
4: $[RuBr_6]^{3-}$
5: $[OsCl_6]^{3-}$
6: $[CrCl_6]^{4-}$
7: $[Ru(NO)Cl_5]^{2-}$
8: $[RuBr_4(H_2O)_2]^{2-}$
9: $[Ru(NO)(H_2O)Cl_4]^{-}$
10: $[RhCl_5(H_2O)]^{2-}$
11: $[Re(NO)Cl_5]^{2-}$
12: $[Re(NO)CN_5]^{2-}$
13: $[Re(NO)ClCN_4]^{2-}$
14: $[Rh(NO)_2Cl_4]^{-}$
15: $[Rh(NO)(H_2O)Cl_4]^{-}$
16: $[Ru(NO)CN_5]^{2-}$
17: $[Fe(CN)_6]^{3-}$
18: $[Rh(NS)Cl_5]^{2-}$
19: $[Os(NO)Cl_5]^{2-}$
20: $[Cr(NO)Cl_5]^{2-}$
21: $[Re(NO)Cl_5]^{-}$
22: $[Os(NS)Cl_4(TeCN)]^{2-}$
23: $[Ru(NS)Cl_5]^{2-}$
24: $[Re(NS)Cl_4(SeCN)]^{2-}$
25: $[Os(NS)Cl(SCN)_4]^{2-}$
26: $[Ir(NO)Cl_5]^{2-}$

One type of these metal ions or complex ions may be employed and the same type of metals or the different type of metals may be employed in combinations of two or more types. Generally, the content of these metal ions or complex ions is suitably between $1\times10^{-9}$ and $1\times10^{-2}$ mole per mole of silver halide, and is preferably between $1\times10^{-8}$ and $1\times10^{-4}$ mole.

Compounds, which provide these metal ions or complex ions, are preferably incorporated into silver halide grains through addition during the silver halide grain formation. These may be added during any preparation stage of the silver halide grains, that is, before or after nuclei formation, growth, physical ripening, and chemical ripening. However, these are preferably added at the stage of nuclei formation, growth, and physical ripening; furthermore, are preferably added at the stage of nuclei formation and growth; and are most preferably added at the stage of nuclei formation.

These compounds may be added several times by dividing the added amount. Uniform content in the interior of a silver halide grain can be carried out. As disclosed in JP-A No. 63-29603, 2-306236, 3-167545, 4-76534, 6-110146, 5-273683, the metal can be distributively occluded in the interior of the grain.

These metal compounds can be dissolved in water or a suitable organic solvent (for example, alcohols, ethers, glycols, ketones, esters, amides, etc.) and then added. Furthermore, there are methods in which, for example, an aqueous metal compound powder solution or an aqueous solution in which a metal compound is dissolved along with NaCl and KCl is added to a water-soluble silver salt solution during grain formation or to a water-soluble halide solution; when a silver salt solution and a halide solution are simultaneously added, a metal compound is added as a third solution to form silver halide grains, while simultaneously mixing three solutions; during grain formation, an aqueous solution comprising the necessary amount of a metal compound is placed in a reaction vessel; or during silver halide preparation, dissolution is carried out by the addition of other silver halide grains previously doped with metal ions or complex ions. Specifically, the preferred method is one in which an aqueous metal compound powder solution or an aqueous solution in which a metal compound is dissolved along with NaCl and KCl is added to a water-soluble halide solution. When the addition is carried out onto grain surfaces, an aqueous solution comprising the necessary amount of a metal compound can be placed in a reaction vessel immediately after grain formation, or during physical ripening or at the completion thereof or during chemical ripening.

Organic silver salts employed in the present invention are reducible silver sources and preferred are organic acids and silver salts of hetero-organic acids having a reducible silver ion source, specifically, long chain (having from 10 to 30 carbon atoms, and preferably from 15 to 25 carbon atoms) aliphatic carboxylic acids and nitrogen-containing heterocyclic ring carboxylic acid. Organic or inorganic silver salt complexes are also useful in which the ligand has a total stability constant for silver ion of 4.0 to 10.0. Examples of preferred silver salts are described in Research Disclosure, Items 17029 and 29963, including organic acid salts (for example, salts of gallic acid, oxalic acid, behenic acid, stearic acid, palmitic acid, lauric acid, etc.); carboxyalkylthiourea salts (for example, 1-(3-carboxypropyl)thiourea, 1-(3-caroxypropyl)-3,3-dimethylthiourea, etc.); silver complexes of polymer reaction products of aldehyde with hydroxy-substituted aromatic carboxylic acid (for example, aldehydes (formaldehyde, acetaldehyde, butylaldehyde, etc.), hydroxy-substituted acids (for example, salicylic acid, benzoic acid, 3,5-dihydroxybenzoic acid, 5,5-thiodisalicylic acid, silver salts or complexes of thioenes (for example, 3-(2-carboxyethyl)-4-hydroxymethyl-4-(thiazoline-2-thioene and 3-carboxymethyl-4-thiazoline-2-thioene), complexes of silver with nitrogen acid selected from imidazole, pyrazole, urazole, 1.2,4-thiazole, and 1H-tetrazole, 3-amino-5-benzylthio-1,2,4-triazole and benztriazole or salts thereof; silver salts of saccharin, 5-chlorosalicylaldoxime, etc.; and silver salts of mercaptides The preferred silver salt is silver behenate.

The added amount of organic silver salts is preferably less than 3 g/m$^2$ in terms of silver amount, and is more preferably less than 2 g/m$^2$.

Organic silver salts can be prepared by mixing a water-soluble silver compound with a compound which forms a complex with silver, and employed preferably are a normal precipitation, a reverse precipitation, a double-jet precipitation, a controlled double-jet precipitation as described in JP-A No. 9-127643.

In the present invention, organic silver salts have an average grain diameter of 1 $\mu$m and are monodispersed. The average diameter of the organic silver salt as described herein is, when the grain of the organic salt is, for example, a spherical, cylindrical, or tabular grain, a diameter of the sphere having the same volume as each of these grains. The average grain diameter is preferably between 0.01 and 0.8 $\mu$m, and is most preferably between 0.05 and 0.5 $\mu$m. Furthermore, the monodisperse as described herein is the same as silver halide grains and preferred monodispersibility is between 1 and 30 percent. In the present invention, the organic silver salts are preferably composed of monodispersed grains with an average diameter of not more than 1 $\mu$m. When grains are prepared within this range, high density images can be obtained.

In the present invention, in order to obtain a given optical transmission density, the total amount of silver halides and organic silver salts is preferably between 0.3 and 1.5 g per m$^2$ in terms of silver amount. When prepared within this range, high contrast images can be obtained.

Reducing agents are preferably incorporated into the thermally processable photosensitive material of the present invention. Examples of suitable reducing agents are described in U.S. Pat. Nos. 3,770,448, 3,773,512, and 3,593,863, and Research Disclosure Items 17029 and 29963, and include the following:

Aminohydroxycycloalkenone compounds (for example, 2-hydroxypiperidino-2-cyclohexane); esters of amino reductones as the precursor of reducing agents (for example, pieridinohexose reducton monoacetate); N-hydroxyurea derivatives (for example, N-p-methylphenyl-N-hydroxyurea); hydrazones of aldehydes or ketones (for example, anthracenealdehyde phenylhydrazone; phosphamidophenols; phosphamidoanilines; polyhydroxybenzenes (for example, hydroquinone, t-butylhydroquinone, isopropylhydroquinone, and (2,5-dihydroxy-phenyl) methylsulfone); sulfydroxamic acids (for example, benzenesulfhydroxamic acid); sulfonamidoanilines (for example, 4-(N-methanesulfonamide)aniline); 2-tetrazolylthiohydroquinones (for example, 2-methyl-5-(1-phenyl-5-tetrazolylthio)hydroquinone); tetrahydroquinoxalines (for example, 1,2,3,4-tetrahydroquinoxaline); amidoxines; azines (for example, combinations of aliphatic carboxylic acid arylhydrazides with ascorbic acid); combinations of polyhydroxybenzenes and hydroxylamines, reductones and/or hydrazine; hydroxamic acids; combinations of azines with sulfonamidophenols; $\alpha$-cyanophenylacetic acid derivatives; combinations of bis-$\beta$-naphthol with 1,3-dihydroxybenzene derivatives; 5-pyrazolones, sulfonamidophenol reducing agents, 2-phenylindane-1,3-dione, etc.; chroman; 1,4-dihydropyridines (for example, 2,6-dimethoxy-3,5-dicarboethoxy-1,4-dihydropyridine); bisphenols (for example, bis(2-hydroxy-3-t-butyl-5-methylphenyl)methane, bis(6-hydroxy-m-tri)mesitol, 2,2-bis(4-hydroxy-3-methylphenyl)propane, 4,5-ethylidene-bis(2-t-butyl-6-methyl)phenol, UV-sensitive ascorbic acid derivatives and 3-pyrazolidones. Of these, particularly preferred reducing agents are hindered phenols.

As hindered phenols, listed are compounds represented by the general formula (A) described below:

General formula (A)

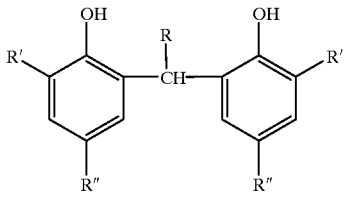

wherein R represents a hydrogen atom or an alkyl group having from 1 to 10 carbon atoms (for example, —$C_4H_9$, 2,4,4-trimethylpentyl), and R' and R" each represents an alkyl group having from 1 to 5 carbon atoms (for example, methyl, ethyl, t-butyl).

Specific examples of the compounds represented by the general formula (A) are described below.

A-1

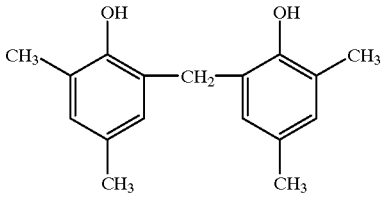

A-2

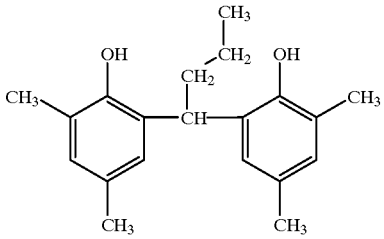

A-3

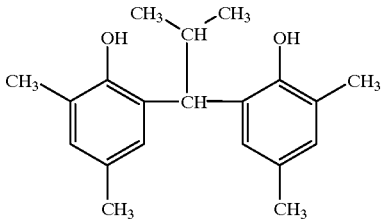

A-4

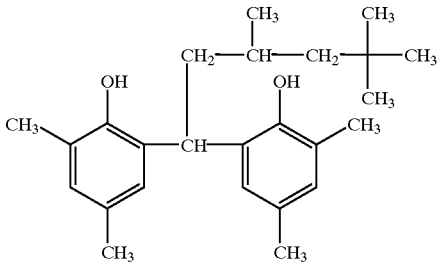

-continued

A-5

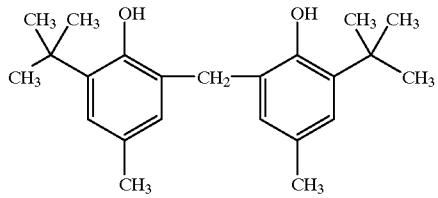

A-6

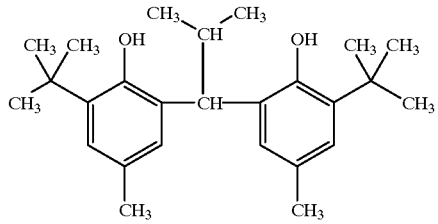

A-7

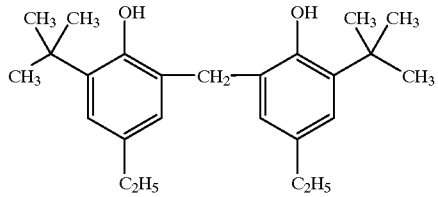

The used amount of reducing agents first represented by the above-mentioned general formula (A) is preferably between $1\times10^{-2}$ and 10 moles, and is more preferably between $1\times10^{-2}$ and 1.5 moles per mole of silver.

Binders suitable for the thermally processable photosensitive material to which the present invention is applied are transparent or translucent, and generally colorless. Binders are natural polymers, synthetic resins, and polymers and copolymers, other film forming media; for example, gelatin, gum arabic, poly(vinyl alcohol), hydroxyethyl cellulose, cellulose acetate, cellulose acetatebutylate, poly (vinylpyrrolidone), casein, starch, poly(acrylic acid), poly (methylmethacrylic acid), poly(vinyl chloride), poly (methacrylic acid), copoly(styrene-maleic acid anhydride), copoly(styrene-acrylonitrile, copoly(styrene-butadiene, poly (vinyl acetal) series (for example, poly(vinyl formal)and poly(vinyl butyral), poly(ester) series, poly(urethane) series, phenoxy resins, poly(vinylidene chloride), poly(epoxide) series, poly(carbonate) series, poly(vinyl acetate) series, cellulose esters, poly(amide) series. These may be hydrophilic or hydrophobic.

In the present invention, the amount of the binder in a photosensitive layer is preferably between 1.5 and 6 g/$m^2$, and is more preferably between 1.7 and 5 g/$m^2$. When the amount is below 1.5 g/$m^2$, the density of an unexposed part markedly increases to occasionally cause no commercial viability.

In the present invention, a matting agent is preferably incorporated into the photosensitive layer side. In order to minimize the image abrasion after thermal development, the matting agent is provided on the surface of a photosensitive material and the matting agent is preferably incorporated in an amount of 0.5 to 10 per cent in weight ratio with respect to the total binder in the emulsion layer side.

Materials of the matting agents employed in the present invention may be either organic substances or inorganic substances. Regarding inorganic substances, for example, those can be employed as matting agents, which are silica described in Swiss Patent No. 330,158, etc.; glass powder described in French Patent No. 1,296,995, etc.; and carbonates of alkali earth metals or cadmium, zinc, etc. described in U.K. Patent No. 1.173,181, etc. Regarding organic substances, as organic matting agents those can be employed which are starch described in U.S. Pat. No. 2,322,037, etc.; starch derivatives described in Belgian Patent No. 625,451, U.K. Patent No. 981,198, etc.; polyvinyl alcohols described in Japanese Patent Publication No. 44-3643, etc.; polystyrenes or polymethacrylates described in Swiss Patent No. 330,158, etc.; polyacrylonitriles described in U.S. Pat. No. 3,079,257, etc.; and polycarbonates described in U.S. Pat. No. 3,022,169.

The shape of the matting agent may be crystalline or amorphous. However, a crystalline and spherical shape is preferably employed. The size of a matting agent is expressed in the diameter of a sphere which has the same volume as the matting agent. The particle diameter of the matting agent in the present invention is referred to the diameter of a spherical converted volume.

The matting agent employed in the present invention preferably has an average particle diameter of 0.5 to 10 $\mu$m, and more preferably of 1.0 to 8.0 $\mu$m. Furthermore, the variation coefficient of the size distribution is preferably not more than 50 percent, is more preferably not more than 40 percent, and is most preferably not more than 30 percent.

The variation coefficient of the size distribution as described herein is a value represented by the formula described below:

(Standard deviation of particle diameter)/(average particle diameter)×100

The matting agent according to the present invention can be incorporated into arbitrary construction layers. In order to accomplish the object of the present invention, the matting agent is preferably incorporated into construction layers other than the photosensitive layer, and is more preferably incorporated into the farthest layer from the support surface.

Addition methods of the matting agent according to the present include those in which a matting agent is previously dispersed into a coating composition and is then coated, and prior to the completion of drying, a matting agent is sprayed. When a plurality of matting agents are added, both methods may be employed in combination.

In the present invention, in cases where the thermally processable photosensitive material is specifically employed for the output of a printing image setter with an oscillation wavelength of 600 to 800 nm, hydrazine derivatives are preferably incorporated into the photosensitive material.

As hydrazine derivatives employed in the present invention, preferred are those having the following general formula (H):

Formula (H)

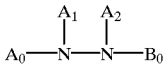

wherein $A_0$ represents an aliphatic group, an aromatic group, a $C_0$—$D_0$ group, or a heterocyclic group, each of which may have a substituent; Bo represents a blocking group; both $A_1$ and $A_2$ represent hydrogen atoms, or one of which represents a hydrogen atom and the other represents an acyl group, a sulfonyl group or an oxalyl group. $C_0$ represents a —CO— group, a —COCO— group, a —CS— group, a —C(=$NG_1D_1$)— group, a —SO— group, —$SO_2$— group or —P(O)($G_1D_l$)— group; $G_1$ represents a simple linking groups such as a —O— group, —S— group, or —N($D_1$)— group; $D_1$ represents an aliphatic group, an aromatic group, a heterocyclic group, or a hydrogen atom; and $D_0$ represents a hydrogen atom, an aliphatic group, an aromatic group, a heterocyclic group, an amino group, an alkoxy group, an aryloxy group, an alkylthio group, or an arylthio group.

In general formula (H), aliphatic groups represented by $A_0$ preferably have from 1 to 30 carbon atoms, and straight, branched or cyclic alkyl groups having from 1 to 20 carbon atoms are particularly preferred and, for example, cited are a methyl group, an ethyl group, a t-butyl group, an octyl group, a cyclohexyl group, and a benzyl group. These may be substituted with a suitable substituent (for example, an aryl group, an alkoxy group, an aryloxy group, an alkylthio group, arylthio group, a sulfoxy group, a sulfonamido group, a sulfamoyl group, an acylamino group, a ureido group, etc.).

In the general formula (H), aromatic groups represented by $A_0$ are preferably mono-ring or condensed ring aryl groups, and cited, for example, are a benzene ring and a naphthalene ring. Heterocyclic groups represented by $A_0$ are preferably mono-ring or condensed ring groups composed of a heterocycle containing at least one hetero atom selected from nitrogen, sulfur, and oxygen atoms, which are, for example, a pyrrolidone ring, an imidazole ring, a tetrahydrofuran ring, a morpholine ring, a pyridine ring, a pyrimidine ring, a quinoline ring, a thiazole ring, a benzothiazole ring, a thiophene ring, or a furan ring; as $A_0$, those particularly preferred are an aryl group, and aromatic groups and heterocyclic groups of $A_0$ may have a substituent and particularly preferred groups include a substituent having an acidic group with a pKa of 7 to 11, and specifically cited are a sulfonamido group, a hydroxyl group, a mercapto group, etc.

In the general formula (H), the —$G_0$—$D_0$— group represented by $A_0$ will now be described. $G_0$ represents a —CO—group, a —COCO— group, a —CS— group, a —C(=$NG_1D_1$)— group, a —SO— group, a —$SO_2$— group, or a —P(O) ($G_1D_1$)— group, and as preferred $G_0$, listed are a —CO— group and a —COCO— group, and as particularly preferred, a —COCO— group is listed. $G_1$ represents a simple linking group such as a —O— group, a —S— group or a —N($D_1$)— group, and $D_1$ represents an aliphatic group, an aromatic group, a hetero-cyclic group, or a hydrogen atom, and when a plurality of $D_1$s are present in a molecule, these may be the same or different.

$D_0$ represents a hydrogen atom, an aliphatic group, an aromatic group, a heterocyclic group, an amino group, an alkoxy group, an aryloxy group, an alkylthio group, an arylthio group, and as preferred $D_0$, listed are a hydrogen atom, an alkyl group, an alkoxy group, an amino group, an aryl group, etc.

In the general formula (H), $A_0$ preferably contains at least one of a nondiffusion group or a silver halide adsorption group. As the nondiffusion group, a ballast group is preferred which is commonly used as immobilizing photographic additives such as couplers, and the ballast groups include an alkyl group, an alkenyl group, an alkynyl group, an alkoxy group, a phenyl group, a phenoxy group, an alkylphenoxy group, etc. which have at least 8 carbon atoms and are photographically inactive.

In the general formula (H), silver halide adsorption accelerators include thiourea, a thiourethane group, a mercapto group, a thioether group, a thione group, a heterocyclic groups, a thioamido heterocyclic group, a mercapto heterocyclic group, or adsorption groups described in JP-A No. 64-90439.

In the general formula (H), $B_0$ represents a blocking group; preferably represents —$G_0D_0$— which is the same as the —$G_0D_0$— group in $A_0$ and $A_0$ and $B_0$ may be different.

Both $A_1$ and $A_2$ represent a hydrogen atom and when one of them represents a hydrogen atom, the other represents an acyl group (for example, an acetyl group, a trifluoroacetyl group, a benzoyl group, etc.), a sulfonyl group (for example, a methanesulfonyl group, a toluenesulfonyl group, etc.), or an oxalyl group (for example, an ethoxalyl group, etc.).

Exemplary examples represented by the general formula (H) are described below.

H-1

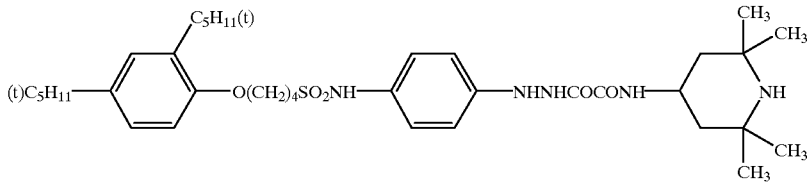

H-2

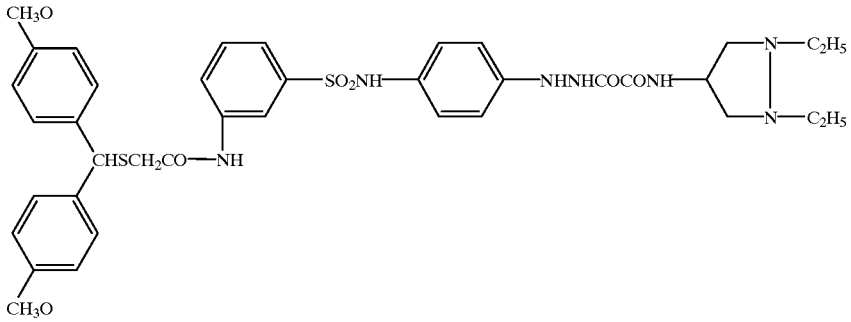

H-3

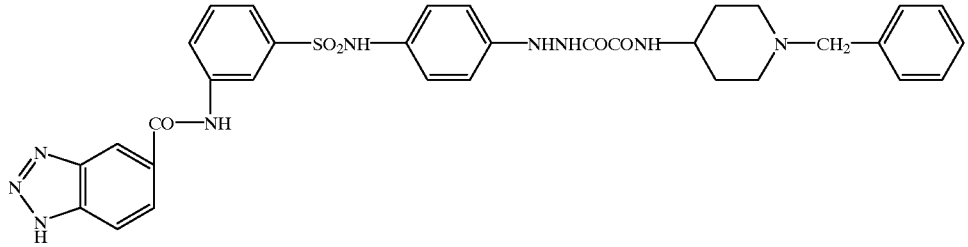

H-4

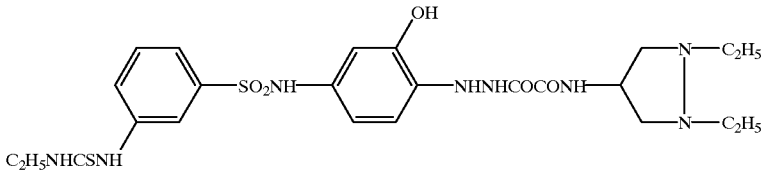

H-5

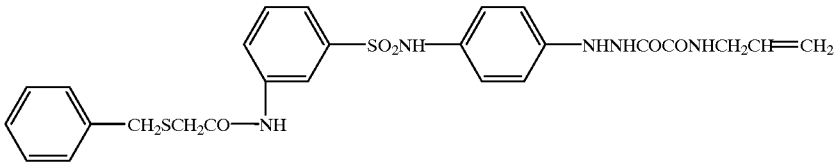

H-6

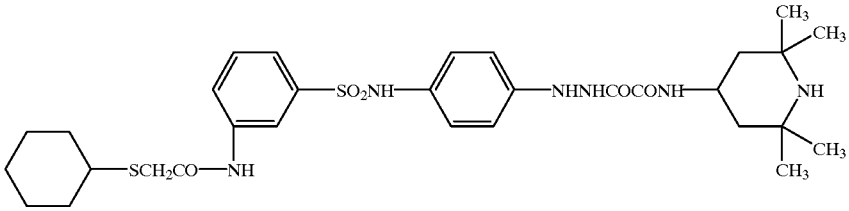

-continued
H-7
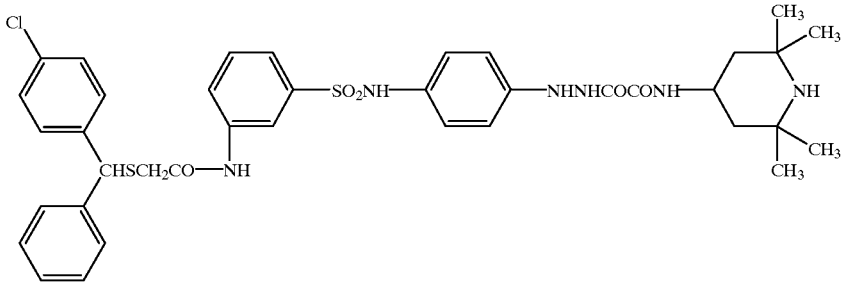
H-8
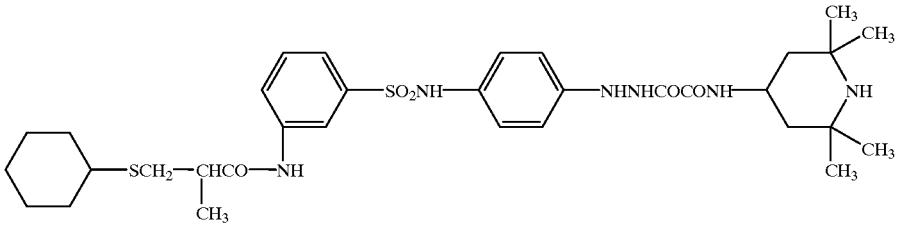
H-9
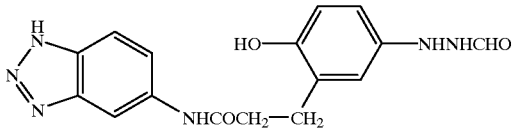
H-10
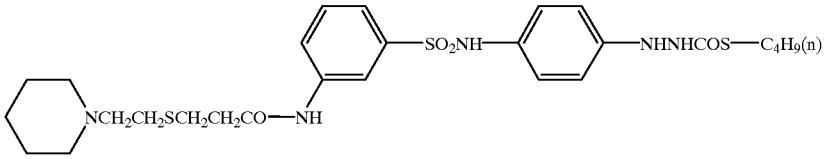
H-11
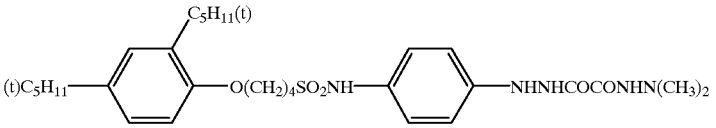
H-12
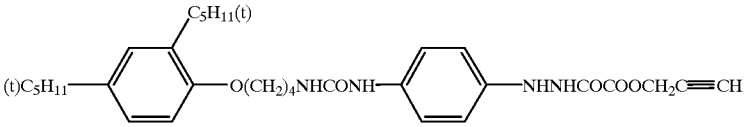
H-13
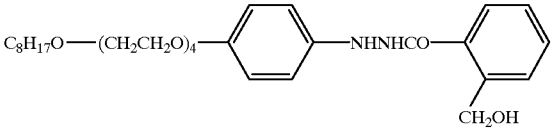
H-14
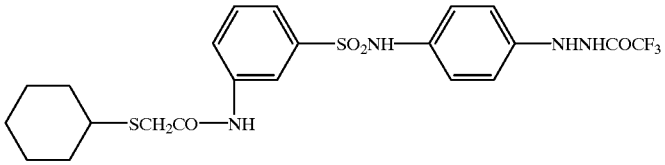

-continued
H-15
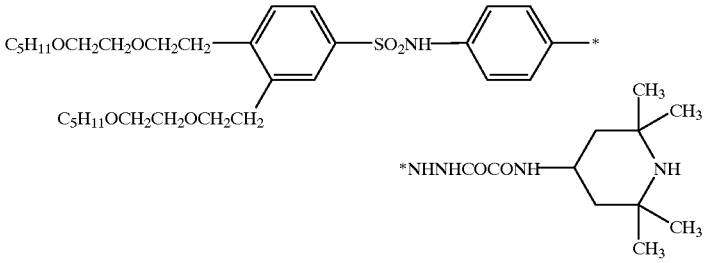
H-16
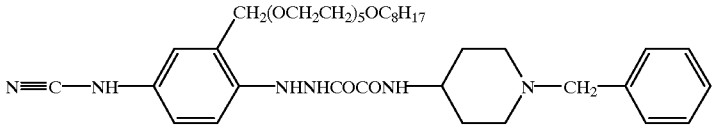
H-17
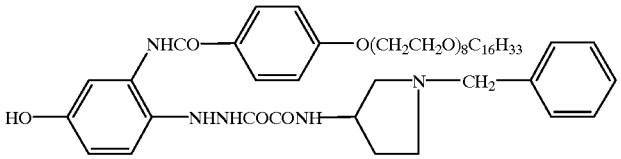
H-18
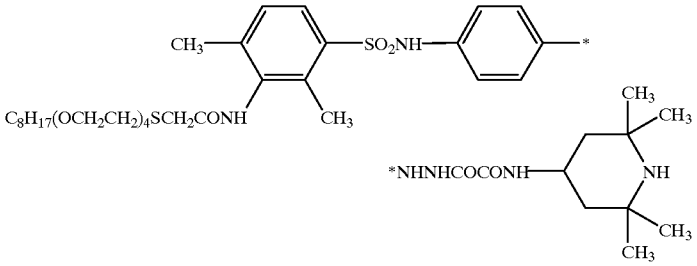
H-19
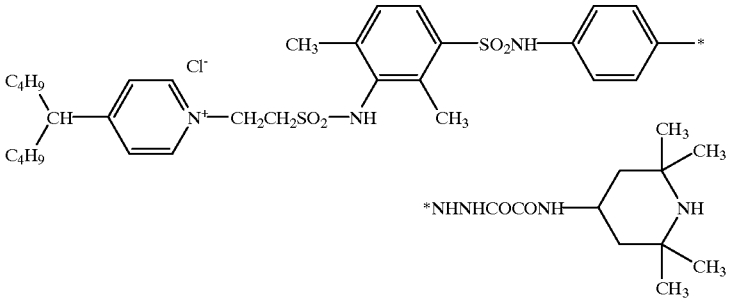
H-20
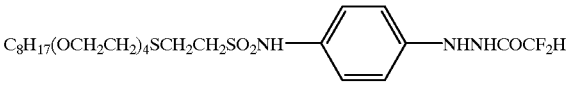
H-21
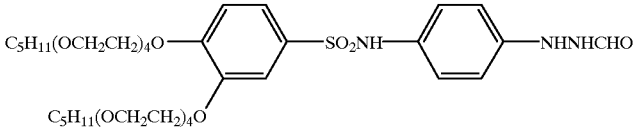

-continued
H-22
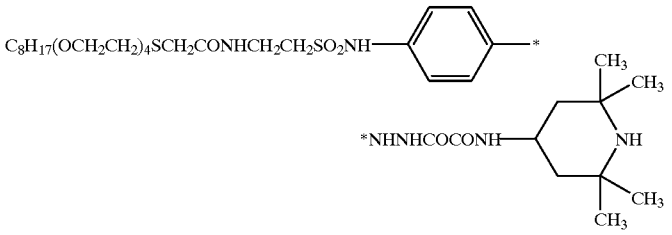
H-23
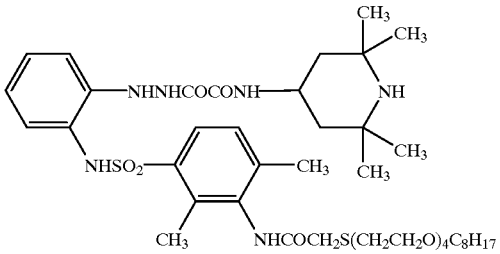
H-24
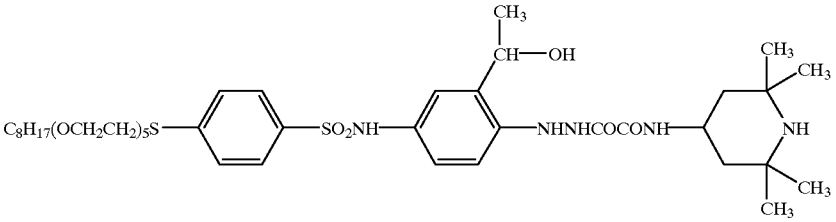
H-25
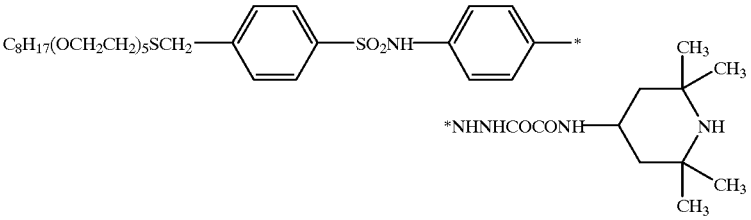
H-26
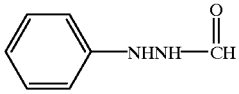
H-27
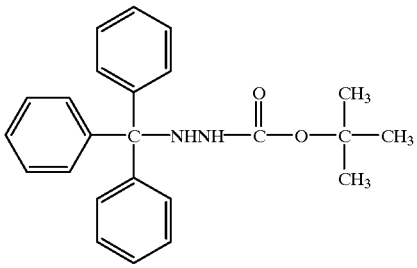

-continued

H-28

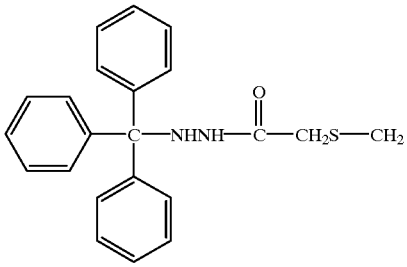

H-29

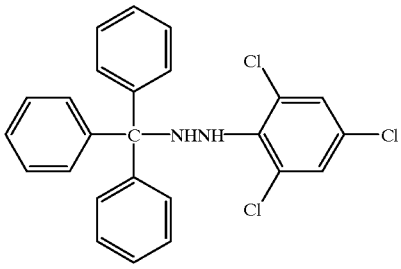

H-30

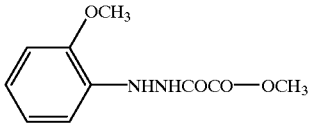

H-31

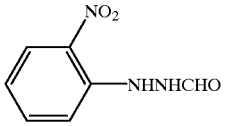

H-32

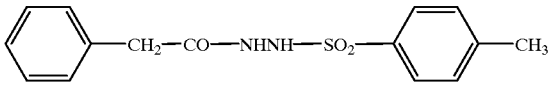

As hydrazine compounds employed in the present invention, other than the compounds described above, those described below may also be employed In addition to the compounds described in Research Disclosure, Item 23516 (November 1983 Issue, page 346) and publications cited therein, listed can be those described in U.S. Pat. Nos. 4,080,207, 4,269,929, 4,276,364, 4,278,748, 4,385,108, 4,459,347, 4,478,928, 4,560,638, 4,686,167, 4,912,016, 4,988,604, 4,994,365, 5,041,355, and 5,104,769; U.K. Patent No. 2,011,391B; European Patent Nos. 217310, 301, 799, and 356,898; and JP-A Nos. 60-179734, 61-170733, 61-270744, 62-178246, 62-270948, 63-29751, 63-32538, 63-104047, 63-121838, 63-129337, 63-223744, 63-234244, 63-234245, 63-234246, 63-294552, 63-306438, 64-10233, 1-90439, 1-100530, 1-105941, 1-105943, 1-276128, 1-280747, 1-283548, 1-283549, 1-285940, 2-2541, 2-77057, 2-139538, 2-196234, 2-196235, 2-198440, 2-198441, 2-198442, 2-220042, 2-221953, 2-221954, 2-285342, 2-285343, 2-289843, 2-302750, 2-304550, 3-37642, 3-54549, 3-125134, 3-184039, 3-240036, 3-240037, 3-259240, 3-280038, 3-282536, 4-51143, 4-56842, 4-84134, 2-230233, 4-96053, 4-216544, 5-45761, 5-45762, 5-45763, 5-45764, 5-45765, 6-289524, and 9-160164, etc.

Furthermore, other than those, employed can be compounds described in (Ka 1) of Japanese Patent Publication (hereinafter, denoted as JP-B) No. 6-77138, specifically, compounds described on pages 3 and 4 of the Publication; compounds represented by general formula (I) in JP-B No. 6-93082, specifically, compounds 1 through 38 described on pages 8 to 18 of the Publication; compounds represented by general formula (4), general formula (5), and general formula (6) in JP-A No. 6-230497, specifically, compounds 4-1 through 4-10 on pages 25 and 26, compounds 5-1 through 5-42 on pages 28 to 36, and compounds 6-1 through 6-7 on pages 39 and 40 of the Publication; compounds represented by general formula (I) and general formula (2) in JP-A No. 6-289520, specifically, compounds 1-1) through 1-17) and 2-1) on pages 5 to 7 of the Publication; compounds described.in (Ka 2) and (Ka 3) of JP-A No. 6-313936, specifically, compounds described on pages 6 to 19 of the Publication; compounds described in (Ka 1) of JP-A No. 6-313951, specifically, compounds described on pages 3 to 5 of the Publication; compounds represented by general formula (I) in JP-A No. 7-5610, specifically, compounds I-1 through I-38 described on pages 5 to 10 of the Publication; compounds represented by general formula (II) in JP-A No. 7-77783, specifically, compounds II-1 through II-102 described on pages 10 to 27 of the Publication; and compounds represented by general formula (H) and general formula (Ha) in JP-A No. 7-104426, specifically, compounds H-1 through H-44 described on pages 8 to 15 of the Publication.

A hydrazine derivative addition layer is a photosensitive layer and/or a constitution layer adjacent to the photosensitive layer. The added amount is preferably in the range of $10^{-6}$ to $10^{-1}$ mole and is more preferably in the range of $10^{-5}$ to $10^{-2}$ mole per mole of silver halide, though the optimum amount is not defined, depending on the silver halide grain size, halide composition, chemical sensitization degree, reducing agent type, retarder type, etc.

Hydrazine compounds may be dissolved in a suitable organic solvent such as, for example, alcohols (methanol, ethanol, propanol, and fluorinated alcohol), ketones (acetone, methyl ethyl ketone), dimethylformamide, dimethyl sulfoxide, methyl cellosolve, etc. and then employed. Furthermore, employing an emulsification dispersion method which has been well known, hydrazine compounds are dissolved in oils such as dibutyl phthalate, tricresyl phthalate, glyceryl triacetate, diethyl phthalate, etc., and auxiliary solvents such as ethyl acetate, cyclohexane, etc., and can be employed upon mechanically preparing emulsified dispersion. Alternatively, employing a method which has been known as a solid dispersion method, the hydrazine compound powders can be dispersed into water using a ball mill, a colloid mill or supersonic wave and then employed.

In combination with hydrazine compounds, into a photosensitive material, incorporated can be nucleation accelerating agents such as amine derivatives, onium salts, disulfide derivatives, hydroxylamine derivatives, etc.

Thermally processable photosensitive materials are stable at normal temperature, and after exposure, when they are heated to high temperatures (for example, between 80 and 140° C.), they are developed. Upon heating them, silver is formed through an oxidation-reduction reaction of an organic silver salt (working as an oxidizing agent) with a reducing agent. This oxidation-reduction reaction is accelerated with a catalytic action of a latent image formed in photosensitive silver halide by exposure. Silver formed by the reaction of an organic silver salt in an exposed area provides a black image. This is in contrast to the unexposed area, and thereby forms an image. This reaction process proceeds without providing a processing solution such as water from the outside.

The thermally processable photosensitive material comprises a support having thereon at least one photosensitive layer, and the photosensitive layer may only be formed on the support. Further, at least one nonphotosensitive layer is preferably formed on the photosensitive layer. In order to control the amount or wavelength distribution of light transmitted through the photosensitive layer, a filter layer may be provided on the same side as the photosensitive layer, or on the opposite side. Dyes or pigments may also be incorporated into the photosensitive layer. As the dyes, preferred are compounds described in Japanese Patent Application No. 7-11184. The photosensitive layer may be composed of a plurality of layers. Furthermore, for gradation adjustment, in terms of sensitivity, layers may be constituted in such a manner as a fast layer/slow layer or a slow layer/fast layer. Various types of additives may be incorporated into any of a photosensitive layer, a nonphotosensitive layer, or other formed layers. In the thermally processable photosensitive material, employed may be, for example, surface active agents, antioxidants, plasticizers, UV absorbers, covering aids, etc.

Image color control agents are preferably incorporated into the thermally processable photosensitive material of the present invention. Examples of suitable image color control agents are disclosed in Research Disclosure Item 17029, and include the following:

imides (for example, phthalimide), cyclic imides, pyrazoline-5-ons, and quinazolinon (for example, succinimide, 3-phenyl-2-pyrazoline-5-on, 1-phenylurazole, quinazoline and 2,4-thiazolidion); naphthalimides (for example, N-hydroxy-1,8-naphthalimide); cobalt complexes (for example, cobalt hexaminetrifluoroacetate), mercaptans (for example, 3-mercapto-1,2,4-triazole); N-(aminomethyl) aryldicarboxyimides (for example, N-(dimethylaminomethyl)phthalimide); blocked pyrazoles, isothiuronium derivatives and combinations of certain types of light-bleaching agents (for example, combination of N,N'-hexamethylene(1-carbamoyl-3,5-dimethylpyrazole), 1,8-(3,6-dioxaoctane)bis-(isothiuroniumtrifluoroacetate), and 2-(tribromomethyl-sulfonyl)benzothiazole; merocyanine dyes (for example, 3-ethyl-5-((3-etyl-2-benzothiazolinylidene-(benzothiazolinylidene))-1-methylethylidene-2-thio-2,4-oxazolidinedione); phthalazinone, phthalazinone derivatives or metal salts thereof (for example, 4-(1-naphthyl)phthalazinone, 6-chlorophthalazinone, 5,7-dimethylphthalazinone, and 2,3-dihydro-1,4-phthalazinedione); combinations of phthalazinone and sulfinic acid derivatives (for example, 6-chlorophthalazinone and benzenesulfinic acid sodium, or 8-methylphthalazinone and p-trisulfonic acid sodium); combinations of phthalazine and phthalic acid; combinations of phthalazine (including phthalazine addition products) with at least one compound selected from maleic acid anhydride, and phthalic acid, 2,3-naphthalenedicarboxylic acid or o-phenylenic acid derivatives and anhydrides thereof (for example, phthalic acid, 4-methylphthalic acid, 4-nitrophthalic acid, and tetrachlorophthalic acid anhydride); quinazolinediones, benzoxazine, nartoxazine derivatives, benzoxazine-2,4-diones (for example, 1,3-benzoxazine-2,4-dione); pyrimidines and asymmetry-triazines (for example, 2,4-dihydroxypyrimidine), and tetraazapentalene derivatives (for example, 3,6-dimercapto-1,4-diphenyl-1H,4H-2,3a,5,6a-tatraazapentalene). Preferred image color control agents include phthalazone or phthalazine.

In the thermally processable photosensitive material used in the present invention, polyhalogen compounds are preferably used, as described in U.S. Pat. Nos. 3,874,946, 4,756,999, 5,340,712; European Patent Nos. 605981A1, 622666A1, 631176A1; JP-B No. 54-165; JP-A Nos. 7-2781, 9-160164, 9-244178, and 9-319022.

In the thermally processable photosensitive material of the present invention, employed can be sensitizing dyes described, for example, in JP-A Nos. 63-159841, 60-140335, 63-231437, 63-259651, 63-304242, and 63-15245; U.S. Pat. Nos. 4,639,414, 4,740,455, 4,741,966, 4,751,175, and 4,835,096. Useful sensitizing dyes employed in the present invention are described, for example, in publications described in or cited in Research Disclosure Items 17643, Section IV-A (page 23, December 1978), 1831, Section X (page 437, August 1978). Particularly, selected can advantageously be sensitizing dyes having the spectral sensitivity suitable for spectral characteristics of light sources of various types of scanners. For example, dyes are preferably selected from: A) for an argon laser, simple merocyanines described in JP-A Nos. 60-162257 and 2-48653; U.S. Pat. 2,161,331; West Germany Patent No. 930,071; and Japanese Patent Application No. 3-198532; B) for helium-neon laser, tri-nucleus cyanine dyes illustrated in Japanese Patent Publication Open to Public Inspection Nos. 50-62425, 54-18726, and 59-102229, and merocyanines illustrated in Japanese Patent Application 6-103272; C) for a LED light source and a red semiconductor laser, thiacarbocyanine described in JP-B Nos. 48-42172, 51-9609, 55-39818; and JP-A Nos. 62-284343 and 2-105135; D) for an infrared semiconductor laser light source, tricarbocyanines described in JP-A Nos. 59-191032 and 60-80841, and dicarbocyanines containing a 4-quinoline nucleus described in general formulas (IIIa) and (IIIb) in JP-A Nos. 59-192242 and 3-67242. These sensitizing dyes may be individually or in combinations thereof. The combinations of sensitizing dyes are frequently for the purpose of supersensitization. The compounds which exhibit no spectral sensitizing action or substantially absorb no visible light and exhibit supersensitization may be incorporated into an emulsion.

Exposure to the thermally processable photosensitive material of the present invention is preferably carried out using an Ar laser (488 nm), a He—Ne laser (633 nm), a red color semiconductor laser (670 nm), an infrared semiconductor laser (780 nm and 830 nm), etc.

EXAMPLES

The present invention is detailed with reference to Examples below, but embodiments of the present invention are not limited to these examples.

Example 1

Preparation of Silver Halide Grains

In 900 ml of deionized water were dissolved 7.5 g of gelatin and 10 mg of potassium bromide. After regulating the temperature to 35° C. and adjusting the pH to 3.0, 370 ml of an aqueous solution containing 74 g of silver nitrate and an aqueous solution containing potassium bromide and potassium iodide in a mole ratio of 96 to 4 were added over a period of 10 minutes by the controlled double-jet method. Thereafter, 0.3 g of 4-hydroxy-6-methyl-1,3,3a,7-tetraazaindene was added and the pH was adjusted to 5 using NaOH. There was obtained cubic silver iodobromide grains having an average grain size of 0.06 $\mu$m, a variation coefficient of the projection area diameter of 8 percent, and a {100} plane ratio of 86 percent. The resulting emulsion was flocculated to remove soluble salts, employing a flocculating agent and after desalting, 0.1 g of phenoxyethanol was added and the pH and pAg were adjusted to 5.9 and 7.5, respectively. Thereafter, each of sensitizing dyes SD-1 and SD-2 was added in an amount of $5\times10^{-5}$ per mole of silver halide. Then, the temperature was elevated to 60° C.; 2 mg of sodium thiosulfate were added, and after ripening for 100 minutes, the resulting emulsion was cooled to 38° C. to complete the chemical ripening to obtain silver halide grains.

Preparation of Organic Fatty Acid Silver Emulsion

To 300 ml of water, 10.6 g of behenic acid was added, and the resulting mixture was heated to 90° C. to dissolve the behenic acid. Then, 31.1 ml of 1N sodium hydroxide was added with stirring; the resulting mixture was left standing for one hour as it was. Then, it was cooled to 30° C., and was added with 7.0 ml of 1N phosphoric acid; was added with 0.01 g of N-bromosuccinic acid while stirring well. Thereafter, silver halide grains previously prepared was added with stirring while heating to 40° C. so as to make 10 mole percent in respect to behenic acid in terms of silver amount. Furthermore, 25 ml of a 1N aqueous silver nitrate solution was continuously added over 2 minutes and the resulting mixture was kept standing for one hour while stirring. To the resulting emulsion, polyvinyl butyral dissolved in ethyl acetate was added and after stirring well, was left standing to form an ethyl acetate phase containing silver behenate grains and silver halide grains and a water phase. After removing the water phase, silver behenate grains and silver halide grains were collected employing centrifugal separation. After that, 20 g of synthesized Zeolite A-3 (spherical) manufactured by Tosoh Corp. and 22 cc of isopropyl alcohol were added and the resulting mixture was kept standing for one hour and was filtered. Further, 3.4 g of polyvinyl butyral and 23 cc of isopropyl alcohol were added and the resulting mixture was subjected to high speed agitation and dispersion to complete the preparation of an organic fatty acid silver emulsion.

Composition of Photosensitive Layer

A photosensitive layer coating composition was prepared as described below. As solvents, methyl ethyl ketone, acetone, and methanol were suitably employed.

| | |
|---|---|
| Organic fatty acid silver emulsion | 1.75 (in silver)/m$^2$ |
| Pyridinium hydrobromide perbromide | $1.5 \times 10^{-4}$ mole/m$^2$ |
| Calcium bromide | $1.8 \times 10^{-4}$ mole/m$^2$ |
| 2-(4-chlorobenzoyl)benzoic acid | $1.5 \times 10^{-3}$ mole/m$^2$ |
| Sensitizing dye-1 | $4.2 \times 10^{-6}$ mole/m$^2$ |
| 2-Mercaptobenzimidazole | $3.2 \times 10^{-3}$ mole/m$^2$ |
| 2-Tribromomethylsulfonylpyridine | $6.0 \times 10^{-4}$ mole/m$^2$ |

Sensitizing dye-1

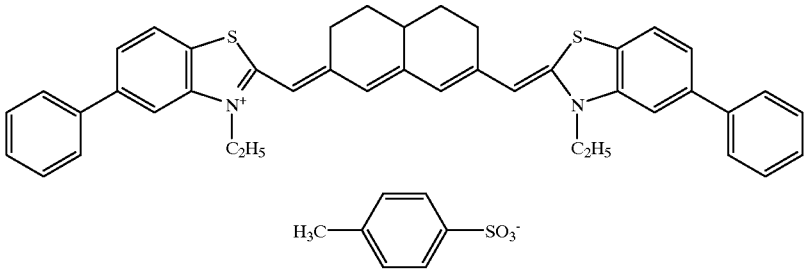

Composition of Surface Protective Layer

A surface protective layer coating composition was prepared as described below. As solvents, methyl ethyl ketone, acetone, and methanol were suitably employed.

| | |
|---|---|
| Cellulose acetate | 4 g/m$^2$ |
| 1,1-bis(2-hydroxy-3,5-dimethylphenyl-3,5,5-trimethyl hexane | $4.8 \times 10^{-3}$ mole/m$^2$ |
| Phthalazine | $3.2 \times 10^{-3}$ mole/m$^2$ |
| 4-Methylphthalic acid | $1.6 \times 10^{-3}$ mole/m$^2$ |

-continued

| | |
|---|---|
| Terachlorophthalic acid | $7.9 \times 10^{-4}$ mole/m$^2$ |
| Terachlorophtalic acid anhydride | $9.1 \times 10^{-4}$ mole/m$^2$ |
| Silicon dioxide (particle diameter of 2 $\mu$m) | 0.22 g/m$^2$ |

Composition of Backing Layer

A backing layer coating composition was prepared as described below.

| | |
|---|---|
| Cellulose acetate | 4 g/m$^2$ |
| Antihalation dyes | |
| Dye D-2 | 0.06 g/m$^2$ |
| Dye D-3 | 0.018 g/m$^2$ |
| Polymethyl methacrylate (particle diameter of 10 $\mu$m) | 0.02 g/m$^2$ |

Dye D-2

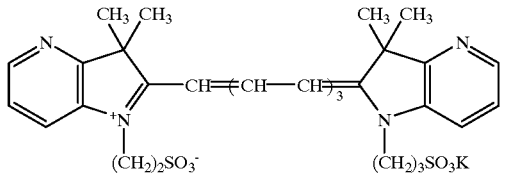

Dye D-3

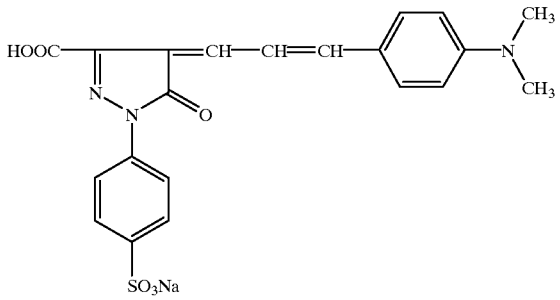

Onto a 175 $\mu$m thick biaxially stretched polyethylene terephthalate film, coating solutions as described above were coated and dried to obtain coated samples 1. Samples 2 to 32 were prepared in a manner similar to Sample 1, except that Pyridinium hydrobromide perbromide contained in the photosensitive layer was replaced by a compound, as shown in Table 1.

Sensitometric Evaluation

The thermally processable photosensitive material as prepared above was cut into a half size and was subjected to exposure using a beam from a 830 nm laser diode declined from the vertical plane by 13°. Thereafter, the exposed sample was subjected to thermal processing at 120° C. for 15 seconds employing a heating drum. Then, the fog value was measured and sensitivity (the reciprocal of exposure necessary to give a density of fog plus 1.0) was also measured. The sensitivity was represented as a relative value, based on the sensitivity of Sample 1 being 100. Results are shown in Table 1.

Evaluation of Raw Stock Stability

In the inside of a tightly sealed vessel, which was maintained at 25° C. and RH 55 percent, three coated samples were placed and were kept at 50° C. for 7 days (accelerated aging). The second sample of these and comparative sample (aged in a light-shielded vessel at room temperature) were subjected to the same processing in a manner similar to sensitometry and the density of fogged portions was measured. The results thereod are shown in Table 1.

Fog increase(1)=(fog at accelerated aging)−(fog at comparative aging)

Evaluation of Image Fastness

One of the two Samples which had been subjected to the same processing as those for the sensitometric evaluation was stored at 25° C. and RH 55% under light-shielding over a period of 7 days and the other one was exposed to natural light at 25° C. and RH 55% over a period of 7 days. The fog density of of each Sample was measured, as below. Results thereof are shown in Table 1.

Fog increase(2)=(fog produced when exposed to natural light)−(fog produced under light-shielded)

TABLE 1

| Sample No. | Compound | Fog | Sensitivity | Fog Increase (1) | Fog increase (2) |
|---|---|---|---|---|---|
| 1 | *1 | 0.41 | 100 | 0.04 | 0.06 |
| 2 | A1 | 0.23 | 108 | 0.01 | 0.03 |
| 3 | A5 | 0.22 | 107 | 0.02 | 0.03 |
| 4 | A19 | 0.22 | 107 | 0.01 | 0.03 |
| 5 | A21 | 0.21 | 107 | 0.02 | 0.03 |
| 6 | A24 | 0.21 | 108 | 0.01 | 0.02 |
| 7 | A29 | 0.21 | 110 | 0.01 | 0.02 |
| 8 | A31 | 0.21 | 110 | 0.01 | 0.02 |
| 9 | A38 | 0.21 | 110 | 0.01 | 0.02 |
| 10 | A49 | 0.22 | 107 | 0.01 | 0.01 |
| 11 | B1 | 0.21 | 108 | 0.01 | 0.01 |
| 12 | B2 | 0.23 | 108 | 0.01 | 0.01 |
| 13 | B4 | 0.22 | 108 | 0.01 | 0.01 |
| 14 | B10 | 0.22 | 107 | 0.01 | 0.01 |
| 15 | B16 | 0.22 | 106 | 0.01 | 0.01 |
| 16 | C1 | 0.22 | 108 | 0.01 | 0.02 |
| 17 | C3 | 0.22 | 109 | 0.01 | 0.02 |
| 18 | C6 | 0.22 | 110 | 0.01 | 0.03 |
| 19 | C9 | 0.21 | 109 | 0.01 | 0.03 |
| 20 | C22 | 0.23 | 110 | 0.01 | 0.02 |
| 21 | D2 | 0.22 | 109 | 0.01 | 0.02 |
| 23 | D9 | 0.24 | 107 | 0.01 | 0.02 |
| 26 | E1 | 0.22 | 110 | 0.01 | 0.02 |
| 27 | E2 | 0.22 | 109 | 0.01 | 0.02 |
| 28 | E9 | 0.22 | 111 | 0.01 | 0.02 |
| 29 | E10 | 0.24 | 112 | 0.01 | 0.02 |
| 30 | E14 | 0.24 | 110 | 0.01 | 0.02 |
| 31 | E18 | 0.24 | 107 | 0.01 | 0.02 |
| 32 | F1 | 0.23 | 107 | 0.01 | 0.02 |
| 33 | G1 | 0.21 | 108 | 0.01 | 0.02 |
| 34 | G9 | 0.22 | 107 | 0.01 | 0.02 |
| 35 | G10 | 0.22 | 108 | 0.01 | 0.02 |

*1: Pyridinium hydrobromide per bromide

As can be seen from Table 1, it is shown that inventive samples exhibited high sensitivity and reduced fog levels, and were also excellent raw stock stability as well as excellent image fastness.

Example 2

Preparation of a Subbed Photographic Support

Preparation of a Subbed PET Photographic Support

Both surfaces of a biaxially stretched thermally fixed 100 $\mu$m PET film, available on the market, was subjected to corona discharging at 8 w/m$^2$·minute. Onto the surface of one side, the subbing coating composition a-1 descried below was applied so as to form a dried layer thickness of 0.8 $\mu$m, which was then dried. The resulting coating was designated Subbing Layer A-1. Onto the opposite surface, the subbing coating composition b-1 described below was applied to form a dried layer thickness of 0.8 μm. The resulting coating was designated Subbing Layer B-1.

| Subbing Coating Composition a-1 | |
|---|---|
| Latex liquid (with a solid portion of 30%) of a copolymer consisting of Butyl acrylate (30 weight % t-butyl acrylate (20 weight %) 2-Hydroxyethyl acrylate (25 weight %) | 270 g |
| (C-1) | 0.6 g |
| Hexamethylene-1,6-bis(ethyleneurea) | 0.8 g |
| Water to make | 1 liter |
| Subbing Coating Composition b-1 | |
| Latex liquid (solid portion of 30%) of a copolymer consisting of butyl acrylate (40 weight %) styrene (20 weight %) glycidyl acrylate (25 weight %) | 270 g |
| (C-1) | 0.6 g |
| Hexamethylene-1,6-bis(ethyleneurea) | 0.8 g |
| Water to make | 1 liter |

Subsequently, the surfaces of Subbing Layers A-1 and B-1 were subjected to corona discharging with 8 w/m$^2$·minute. Onto the Subbing Layer A-1, the upper subbing layer coating composition a-2 described below was applied so as to form a dried layer thickness of 0.8 μm, which was designated Subbing Layer A-2, while onto the Subbing Layer B-1, the upper subbing layer coating composition b-2 was applied so at to form a dried layer thickness of 0.8 μm, having a static preventing function, which was designated Subbing Upper Layer B-2.

| <Upper Subbing Layer Coating Composition a-2> | |
|---|---|
| Gelatin amount to make | 0.4 g/m$^2$ |
| (C-1) | 0.2 g |
| (C-2) | 0.2 g |
| (C-3) | 0.1 g |
| Silica particles (average diameter of 3 μm) | 0.1 g |
| Water to make | 1 liter |
| <Upper Subbing Layer Coating Composition b-2> | |
| (C-4) | 60 g |
| Latex liquid (solid portion of 20%) comprising (C-5) as a substituent | 80 g |
| Ammonium sulfate | 0.5 g |
| (C-6) | 12 g |
| Polyethylene glycol (average molecular weight of 600) | 6 g |
| Water to make | 1 liter |

(C-1)

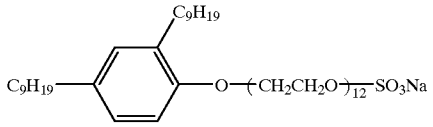

(C-2)

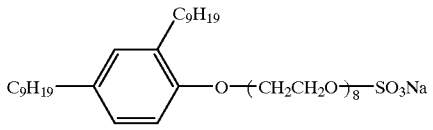

-continued (C-3)

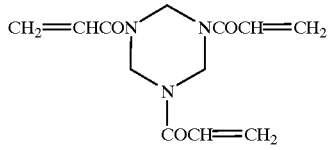

(C-4)

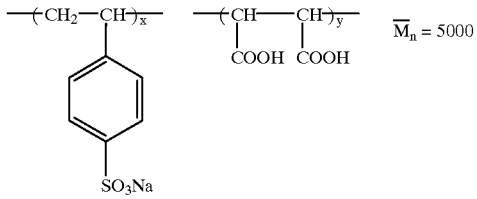

($\overline{M}$n is a number average molecular weight)
x:y = 75:25 (weight ratio)

(C-5)

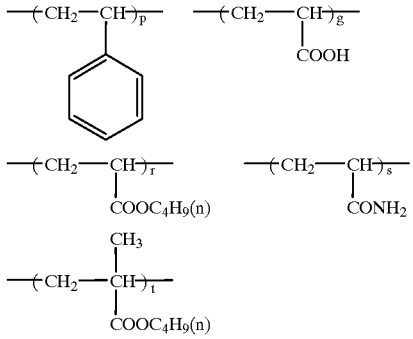

p:g:r:s:t = 40:5:10:5:40 (weight ratio)

(C-6)

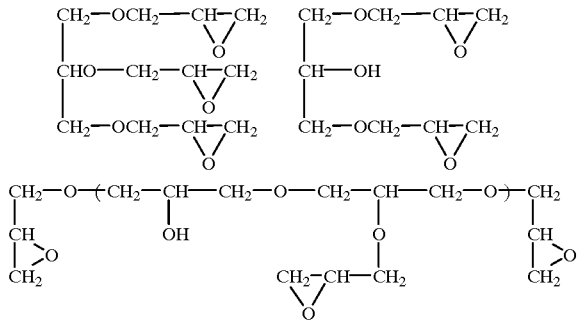

Mixture consisting of the three compounds illustrated above

Preparation of Emulsion A

In 900 ml of water, 7.5 g of inert gelatin and 10 mg of potassium bromide were dissolved. After adjusting the temperature to 35° C. and the pH to 3.0, 370 ml of an aqueous solution containing 74 g of silver nitrate, an aqueous solution containing potassium bromide and potassium iodide in a mole ratio of 98/2, $1\times10^{-4}$ mole of $Ir(NO)Cl_6$ salt per mole of silver, and $1\times10^{-4}$ mole of rhodium chloride salt per mole of silver were added over 10 minutes employing a controlled double-jet method while maintaining the pAg at 7.7. Thereafter, 0.3 g of 4-hydroxy-6-methyl-1,3,3a,7-tetraazaindene was added and the pH was adjusted to 5, using NaOH. Thus, obtained were cubic silver iodobromide grains having an average grain size of 0.06 μm, a variation coefficient of projection area diameter of 8 percent, and a [100] face ratio of 87 percent. The resulting emulsion was subjected to desalting through flocculation precipitation, employing a flocculaing agent. After that, 0.1 g of phenoxyethanol was added, and the pH and pAg were adjusted to 5.9 and 7.5, respectively, to obtain a silver halide emulsion.

In accordance with the method in Example 1 of Japanese Patent Publication Open to Public Inspection No. 9-127643, silver behenate was prepared employing the method described below.

Preparation of Sodium Behenate Solution

To 340 ml of isopropanol, 34 g of behenic acid was dissolved at 65° C. Thereafter, while stirring, an aqueous 25N sodium hydroxide solution was added so that the pH was adjusted to 8.7. At the same time, about 400 ml of an aqueous sodium hydroxide solution were employed. Thereafter, the resulting sodium behenate solution was concentrated under reduced pressure so that the concentration of sodium behenate became 8.8 percent by weight.

Preparation of Silver Behenate

To a solution prepared by dissolving 30 g of ossein gelatin in 750 ml distilled water, a 2.94M silver nitrate solution was added to result in a silver electrical potential of 400 mV. To the resulting solution, 374 ml of the above-mentioned sodium behenate solution was added at a rate of 44.6 ml/minute at 78° C., employing a controlled double-jet method, at the same time, an aqueous 2.94M silver nitrate solution was added to maintain the silver electrical potential at 400 mV. During the addition, the added amounts of sodium behenate and silver nitrate were 0.092 mole and 0.101 mole, respectively. After the addition, stirring continued for another 30 minutes, and the resulting water-soluble salts were removed using ultrafiltration.

Preparation of Photosensitive Emulsion

To 0.1 mole of the resulting silver behenate B, 0.01 mole of the above-mentioned silver halide emulsion A was added. Under constantly stirring, dispersion flocks were formed by gradually adding 100 g of a n-butyl acetate solution containing vinyl acetate (1.2 percent by weight). Subsequently, water was removed and further, water washing and water removal were carried out two more times. Then, with stirring, added was 60 g of a mixture consisting of butyl acetate containing 2.5 weight percent polyvinyl butyral (average molecular weight of 3,000) as a binder and isopropyl alcohol in a ratio of 1:2. Thereafter, a gel-like mixture consisting of behenic acid and silver halide, as prepared above, was added with polyvinyl butyral (average molecular weight of 4,000) as a binder and isopropyl alcohol, and was dispersed. Onto a support, each layer described below was subsequently applied to prepare samples. Further, each sample was dried at 75° C. for 5 minutes. Coating onto Back Side Surface: the composition described below was coated to form a wet thickness of 80 μm.

| | |
|---|---|
| Polyvinyl butyral (10 percent isopropanol solution) | 150 ml |
| Dye-B | 70 mg |
| Dye-C | 70 mg |

Dye-B

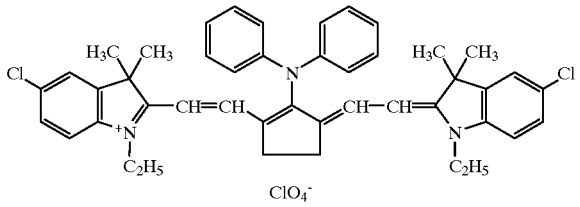

Dye-C

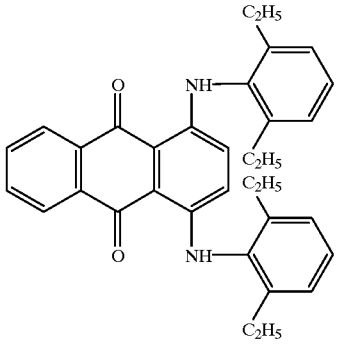

Coating onto the Photosensitive Layer Side

Photosensitive layer: the composition described below was coated so that the coated silver amount was 2.0 g/m$^2$ and polyvinyl butyral as a binder was 3.2 g/m$^2$.

| | |
|---|---|
| Emulsion A as silver amount to make | 3 g/m$^2$ |
| Sensitizing dye-1 (0.1% DMF solution) | 2 mg |
| Pyridinium hydrobromide per bromide (2% acetone solution) | 1 ml |
| 2-tribromomethylsulfonylpyridine (2% acetone solution) | 3 ml |
| Phthalazone (4.5% DMF solution) | 8 ml |
| Developing agent-1 (10% acetone solution) | 13 ml |
| Contrast increasing agent H (1% methanol:DMF = 4:1 solution | 2 ml |

Developing agent-1

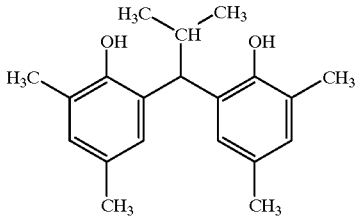

Contrast enhancing agent H

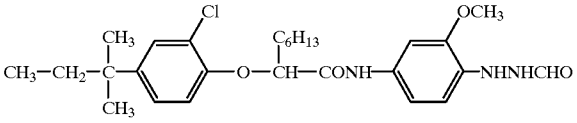

Surface protective layer: the composition described below was coated onto the photosensitive layer so as to obtain a wet thickness of 100 μm.

| | |
|---|---|
| Acetone | 175 ml |
| 2-Propanol | 40 ml |
| Methanol | 15 ml |
| Cellulose acetate | 8.0 g |
| Phthalazine | 1.0 g |
| 4-Methylphthalic acid | 0.72 g |
| Tetrachlorophthalic acid | 0.22 g |
| Tetrachlorophthalic acid anhydride | 0.5 g |
| Monodisperse silica with an average particle diameter of 4 $\mu$m | 1% (W/W) based on binder |

Sample 36 was thus prepared. Samples 37 to 65 were prepared in a manner similar to Sample 36, except that pyridinium hydrobromide perbromide contained in the photosensitive layer was replaced by a compound shown in Table 2.

Sensitometric Evaluation

Each of the thermally processable photosensitive materials prepared as described above was subjected to exposure using a He—Ne laser of 633 nm through a halftone screen having 300 lines per inch, with varying exposure by 5% at a time. Thereafter, the material was subjected to thermal development at 115° C. for 15 seconds employing a heating drum. Sensitivity was represented as a reciprocal of exposure necessary to give a density of 3.0 was referred to as its sensitivity. The sensitivity was shown as a relative value, based on the sensitivity of Sample 36 being 100. Furthermore, a gradient showing the slope of a straight line connecting a point at a density of 0.1 and a point at a density of 1.5 on the characteristic curve was shown as $\gamma_{0115}$ which exhibits the degree of definition at the toe-portion.

Evaluation of Raw Stock Stability

In a tightly sealed vessel of the inside which was maintained at 25° C. and RH 55 percent, three coated Samples were placed and stored at 50° C. for 7 days (accelerated aging). The second Sample of these and comparative Sample (aged in a light-shielded vessel at room temperature) were subjected to processing in the same manner as in sensitometry and the density of fogged portions was measured. The results thereof are shown in Table 2.

Fog increase(1)=(fog produced at accelerated aging)−(fog produced atcomparative aging)

Evaluation of Image Fastness

One of the two Samples which had been subjected to the same processing as those for the sensitometric evaluation was stored at 25° C. and RH 55% under light-shielding for 7 days and the other one was exposed to natural light at 25° C. and RH 55% for 7 days. The density of a fog portion of each Sample was measured. Results thereof are shown in Table 2.

Fog increase(2)=(fog produced when exposed to natural light)−(fog produced under light-shielding)

TABLE 2

| Sample No. | Compound | Fog | Sensitivity | γ0115 | Fog Increase (1) | Fog increase (2) |
|---|---|---|---|---|---|---|
| 36 | *1 | 0.42 | 100 | 5 | 0.06 | 0.07 |
| 37 | A2 | 0.25 | 111 | 14 | 0.02 | 0.02 |
| 38 | A6 | 0.24 | 110 | 15 | 0.02 | 0.02 |
| 39 | A9 | 0.25 | 111 | 16 | 0.02 | 0.02 |

TABLE 2-continued

| Sample No. | Compound | Fog | Sensitivity | γ0115 | Fog Increase (1) | Fog increase (2) |
|---|---|---|---|---|---|---|
| 40 | A24 | 0.23 | 108 | 14 | 0.02 | 0.02 |
| 41 | A25 | 0.22 | 107 | 15 | 0.01 | 0.01 |
| 42 | A27 | 0.19 | 111 | 14 | 0.01 | 0.01 |
| 43 | A30 | 0.21 | 107 | 11 | 0.02 | 0.02 |
| 44 | A49 | 0.22 | 109 | 13 | 0.02 | 0.01 |
| 45 | B1 | 0.22 | 108 | 13 | 0.03 | 0.02 |
| 46 | B2 | 0.23 | 108 | 13 | 0.03 | 0.02 |
| 47 | B8 | 0.22 | 107 | 13 | 0.03 | 0.02 |
| 48 | B11 | 0.22 | 108 | 14 | 0.03 | 0.02 |
| 49 | B16 | 0.22 | 109 | 14 | 0.03 | 0.02 |
| 50 | C1 | 0.22 | 110 | 15 | 0.02 | 0.02 |
| 51 | C3 | 0.24 | 110 | 15 | 0.02 | 0.02 |
| 52 | C11 | 0.23 | 110 | 13 | 0.01 | 0.01 |
| 53 | C21 | 0.26 | 110 | 14 | 0.01 | 0.01 |
| 54 | C27 | 0.23 | 107 | 14 | 0.02 | 0.01 |
| 55 | D1 | 0.23 | 108 | 15 | 0.03 | 0.01 |
| 57 | D12 | 0.24 | 107 | 14 | 0.03 | 0.01 |
| 59 | D24 | 0.22 | 107 | 14 | 0.02 | 0.01 |
| 61 | E2 | 0.23 | 107 | 13 | 0.01 | 0.01 |
| 62 | E15 | 0.24 | 108 | 14 | 0.01 | 0.01 |
| 63 | G1 | 0.23 | 108 | 14 | 0.01 | 0.01 |
| 64 | G9 | 0.23 | 107 | 13 | 0.01 | 0.01 |
| 65 | G18 | 0.23 | 108 | 14 | 0.02 | 0.01 |

As can be seen from Table 2, it is shown that Samples of the present invention exhibit sufficiently high sensitivity, excellent contrast property with high gamma, reduced fog levels, excellent raw stock stability of the photosensitive material and excellent image fastness.

What is claimed is:

1. A thermally processable photosensitive material comprising a support having thereon an organic silver salt, a photosensitive silver halide, a binder, and a nitrogen-containing acyclic compound associated with a pair of halogen atoms;

said acyclic compound being of formula 3:

formula 3

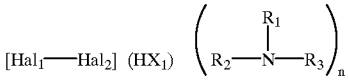

wherein each of $Hal_1$ and $Hal_2$ is a halogen atom; $X_1$ is an acid residue; $R_1$ is a group having a carboxy group; and each of $R_2$ and $R_3$ is a hydrogen atom or a substituent capable of being substituted onto said nitrogen atom, except that $R_2$ and $R_3$ are not halogen atoms, n being 1 or 2.

2. The thermally processable photosensitive material of claim 1, wherein said pair of halogen atoms is a pair of bromine atoms.

3. The thermally processable photosensitive material of claim 1, wherein in formula 3, $Hal_1$, $Hal_2$ and $X_1$ each are a bromine atom.

4. The image forming method of claim 1 wherein said substituent is selected from the group consisting of halogen, alkyl, alkenyl, alkynyl, aryl, amino, acyl, alkoxycarbonyl, aryloxycarbonyl, acylamino, alkoxycarbonylamino, aryloxycarbonylamino, sulfonylamino, sulfamoyl, carbamoyl, alkylsulfonyl, arysulfonyl, sulfinyl, ureido, silyl, nitro, hydroxy, a phosphoric acid ester, and a heterocyclic group.

* * * * *